US010161647B2

(12) United States Patent
Tanaka et al.

(10) Patent No.: US 10,161,647 B2
(45) Date of Patent: Dec. 25, 2018

(54) AIR-CONDITIONING APPARATUS

(71) Applicants: Kosuke Tanaka, Tokyo (JP); Osamu Morimoto, Tokyo (JP); Hirofumi Koge, Tokyo (JP); Tadashi Ariyama, Tokyo (JP)

(72) Inventors: Kosuke Tanaka, Tokyo (JP); Osamu Morimoto, Tokyo (JP); Hirofumi Koge, Tokyo (JP); Tadashi Ariyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 390 days.

(21) Appl. No.: 14/427,678

(22) PCT Filed: Oct. 2, 2012

(86) PCT No.: PCT/JP2012/075543
§ 371 (c)(1),
(2) Date: Mar. 12, 2015

(87) PCT Pub. No.: WO2014/054120
PCT Pub. Date: Apr. 10, 2014

(65) Prior Publication Data

US 2015/0316284 A1 Nov. 5, 2015

(51) Int. Cl.
*F24F 11/00* (2018.01)
*F24F 5/00* (2006.01)
(Continued)

(52) U.S. Cl.
CPC ..... *F24F 11/008* (2013.01); *F24F 5/001* (2013.01); *F24F 11/83* (2018.01); *F25B 13/00* (2013.01);
(Continued)

(58) Field of Classification Search
CPC ..... F25B 2600/02; F25B 2600/0271; F25B 31/006; F25B 31/008; F25B 2700/21152; F25B 13/00; F25B 13/02; F24F 11/008
See application file for complete search history.

(56) References Cited

U.S. PATENT DOCUMENTS

2009/0013700 A1* 1/2009 Unezaki ..... F25B 9/008 62/77
2009/0071177 A1* 3/2009 Unezaki ..... F25B 13/00 62/196.1
2011/0000240 A1* 1/2011 Yamada ..... F25B 49/005 62/208

FOREIGN PATENT DOCUMENTS

CN 101441006 A 5/2009
EP 0 496 505 A2 7/1992
(Continued)

OTHER PUBLICATIONS

International Search Report of the International Searching Authority dated Dec. 25, 2012 for the corresponding international application No. PCT/JP2012/075543 (and English translation).
(Continued)

*Primary Examiner* — Frantz Jules
*Assistant Examiner* — Lionel Nouketcha
(74) *Attorney, Agent, or Firm* — Posz Law Group, PLC

(57) ABSTRACT

Provided is an air-conditioning apparatus capable of performing a cooling and heating mixed operation, including: a heat source unit including a compressor; a plurality of indoor units; a relay unit; a first relay unit-side bypass pipe configured to cause a part of refrigerant, which is discharged from the compressor and flows into the relay unit, to flow between a heat source unit-side heat exchanger and an indoor unit-side heat exchanger; a second relay unit-side flow rate control device provided to the first relay unit-side bypass pipe; and a controller configured to control an
(Continued)

opening degree of the second relay unit-side flow rate control device so that, in an operation in which the heat source unit-side heat exchanger functions as an evaporator, a discharge temperature of a discharge refrigerant discharged from the compressor is equal to or lower than a heat-resistant temperature of the compressor.

9 Claims, 14 Drawing Sheets

(51) Int. Cl.

| | |
|---|---|
| ***F25B 13/00*** | (2006.01) |
| ***F25B 49/02*** | (2006.01) |
| ***F24F 11/83*** | (2018.01) |
| *F25B 31/00* | (2006.01) |

(52) U.S. Cl.
CPC ..... *F25B 49/02* (2013.01); *F25B 31/006* (2013.01); *F25B 31/008* (2013.01); *F25B 2313/006* (2013.01); *F25B 2313/0231* (2013.01); *F25B 2313/02741* (2013.01); *F25B 2400/23* (2013.01); *F25B 2500/31* (2013.01); *F25B 2600/0271* (2013.01); *F25B 2600/2509* (2013.01); *F25B 2700/21152* (2013.01)

(56) References Cited

FOREIGN PATENT DOCUMENTS

| | | | | | |
|---|---|---|---|---|---|
| JP | 4-225756 | A | | 8/1992 | |
| JP | 04225756 | A | * | 8/1992 | |
| JP | 5-5576 | A | | 1/1993 | |
| JP | 06-180164 | A | | 6/1994 | |
| JP | 10-176869 | A | | 6/1998 | |
| JP | 2004-085019 | A | | 3/2004 | |
| JP | 2007-263440 | A | | 10/2007 | |
| JP | 2007263440 | A | * | 10/2007 | |
| JP | 2009-198099 | A | | 9/2009 | |
| JP | 2010-276239 | A | | 12/2010 | |
| JP | 2010276239 | A | * | 12/2010 | |
| JP | 4675810 | B2 | | 2/2011 | |
| JP | 4989511 | B2 | | 5/2012 | |
| JP | 4989511 | B2 | * | 8/2012 | |
| JP | WO 2012104893 | A1 | * | 8/2012 | ..... F25B 9/006 |
| WO | 2012/104893 | A1 | | 8/2012 | |

OTHER PUBLICATIONS

Japanese Office Action dated Nov. 10, 2015 in the corresponding JP application No. 2014-539514. ( English translation attached).
Office Action dated Dec. 30, 2015 in the corresponding CN application No. 201280076215.0 (with English translation).
Office Action dated May 24, 2016 issued in corresponding JP patent application No. 2014-539514 (and English translation).
Extended European Search Report dated Jun. 21, 2016 issued in corresponding EP patent application No. 12886102.8.
Communication pursuant to Article 94(3) EPC dated Aug. 13, 2018 in the corresponding European Patent Application No. 12 886 102.8.

* cited by examiner

COOLING ONLY OPERATION

COOLING MAIN OPERATION

HEATING ONLY OPERATION

HEATING MAIN OPERATION

AIR-CONDITIONING APPARATUS

This application is a U.S. national stage application of PCT/JP2012/075543 filed on Oct. 2, 2012, the contents of which are incorporated herein by reference.

TECHNICAL FIELD

The present invention relates to an air-conditioning apparatus.

BACKGROUND

For example, in an air-conditioning apparatus using a refrigeration cycle (heat pump cycle), a heat source side unit (heat source unit, outdoor unit) including a compressor and a heat source unit-side heat exchanger and a load-side unit (indoor unit) including a flow rate control device (such as an expansion valve) and an indoor unit-side heat exchanger are connected to each other by refrigerant pipes to construct a refrigerant circuit for circulating refrigerant. Then, a phenomenon that the refrigerant is evaporated or condensed in the indoor unit-side heat exchanger by receiving or transferring heat from or to air in an air-conditioned space, which is a heat exchange target, is used to condition the air while a pressure, a temperature, and the like of the refrigerant in the refrigerant circuit are changed. In this case, for example, there is known an air-conditioning apparatus capable of performing a simultaneous cooling and heating operation (cooling and heating mixed operation) in which a plurality of indoor units can each automatically determine whether cooling or heating is suitable in accordance with a temperature set by a remote controller (not shown) provided to the indoor unit and an air temperature around the indoor unit, thereby being capable of performing cooling and heating by each indoor unit.

In addition, the following air-conditioning apparatus to be installed in cold districts or the like is known. In order to enhance a heating capacity (the amount of heat (per time) to be supplied to the indoor unit side through a refrigerant cycle by a compressor in heating; the capacities including a cooling capacity are hereinafter referred to as "capacity") when the outdoor air (hereinafter referred to as "outside air") is low, the air-conditioning apparatus is added with a circuit for causing refrigerant to flow (for injecting refrigerant) into an intermediate portion of a compression stroke of the compressor provided in the heat source unit through an injection pipe (see, for example, Patent Literature 1).

In the air-conditioning apparatus disclosed in Patent Literature 1, the injection is performed to increase the density of the refrigerant to be discharged from the compressor, to thereby enhance the capacity. Further, at the same time, in the case where the ratio of the number of indoor units that perform heating (hereinafter referred to as "heating indoor units") among all the indoor units in the cooling and heating mixed operation is high (heating main operation), an evaporating pressure in an indoor unit that performs cooling (hereinafter referred to as "cooling indoor unit") is controlled by a heat source unit-side flow rate control device.

In this kind of air-conditioning apparatus that is capable of performing the cooling and heating mixed operation and that performs the injection, if the heating capacity is enhanced so as to suit the heating indoor unit, the pressure of the refrigerant on the refrigerant outlet side of the indoor side heat exchanger serving as an evaporator is increased in the cooling indoor unit as well to reduce the pressure difference, with the result that the cooling capacity supplied to the cooling indoor unit is reduced. Thus, the control of the evaporating pressure in the cooling indoor unit by the heat source unit-side flow rate control device in the heating main operation as disclosed in Patent Literature 1 can avoid the problem of the reduction in cooling capacity, thereby securing (maintaining) the cooling capacity.

PATENT LITERATURE

Patent Literature 1: Japanese Patent No. 4989511 (Page 23 and FIG. 1)

However, in the case where the ratio of the number of operating cooling indoor units in the heating main operation is high under the low outside air environment, the state of the refrigerant flowing into the injection pipe is close to a saturated gas. Specifically, the enthalpy of the refrigerant is high, and hence the effect of reducing a discharge temperature of the compressor when the injection is performed is low, and the compressor discharge temperature excessively rises. Accordingly, in terms of heat-resistant protection of a motor material of the compressor, an operating capacity of the compressor needs to be reduced or the compressor needs to be stopped so that the discharge temperature may be equal to or lower than a heat-resistant temperature of the motor material, resulting in a problem in that a desired heating capacity or a desired cooling capacity cannot be exerted. Thus, there are problems in that the comfort for a user is deteriorated and the temperature in the air-conditioned space cannot be maintained to the set temperature.

Further, in the case of an R32 refrigerant, the discharge temperature of the compressor rises by about 30 degrees C. as compared to R410A, R407C, R22, and other such refrigerants in terms of refrigerant physical properties. Accordingly, when the R32 refrigerant is used, the compressor discharge temperature tends to excessively rise, similarly resulting in a problem in that a desired heating capacity cannot be exerted because of the protection of the compressor. Thus, an air-conditioning apparatus capable of suppressing an excessive rise in discharge temperature in the heating only operation as well as the heating main operation in order to deal with this kind of refrigerant is in demand.

SUMMARY

The present invention has therefore been made in view of the above-mentioned circumstances, and it is an object thereof to provide a highly-reliable air-conditioning apparatus capable of performing a simultaneous cooling and heating operation, which is capable of suppressing a discharge temperature of a compressor to be equal to or lower than a heat-resistant temperature of the compressor without stopping the operation even under an operating condition in which the compressor discharge temperature excessively rises, thereby being capable of securing the comfort for a user or maintaining a constant temperature in an air-conditioned space.

According to one embodiment of the present invention, there is provided an air-conditioning apparatus capable of performing a cooling and heating mixed operation, including: a refrigerant circuit formed by piping connection of: a heat source unit including: a compressor; a heat source unit-side heat exchanger configured to exchange heat between an outside air and refrigerant; a heat source unit-side flow rate control device; and a four-way switching valve; a plurality of indoor units each including: an indoor unit-side heat exchanger configured to exchange heat between an air to be conditioned and the refrigerant; and an indoor unit-side flow rate control device; and a relay unit connected between the heat source unit and the plurality of indoor units, and configured to form a passage for supplying a gas refrigerant to the indoor unit that performs heating and supplying a liquid refrigerant to the indoor unit that performs cooling; a bypass pipe configured to cause a part of the refrigerant, which is discharged from the compressor and flows into the relay unit, to flow between the heat source unit-side heat exchanger and the indoor unit-side heat exchanger; a bypass flow rate control device provided to the bypass pipe; and a controller configured to control an opening degree of the bypass flow rate control device so that, in an operation in which the heat source unit-side heat exchanger functions as an evaporator, a discharge temperature of a discharge refrigerant discharged from the compressor is equal to or lower than a heat-resistant temperature of the compressor.

According to one embodiment of the present invention, the control of the opening degree of the bypass flow rate control device in the operation in which the heat source unit-side heat exchanger functions as the evaporator can suppress the discharge temperature of the compressor to be equal to or lower than the heat-resistant temperature of the compressor without stopping the operation even under the operating condition in which the compressor discharge temperature excessively rises. As a result, it is possible to obtain the highly-reliable air-conditioning apparatus capable of securing the comfort for the user or maintaining a constant temperature in the air-conditioned space.

DETAILED DESCRIPTION

Now, embodiments of the present invention are described in detail with reference to the drawings.

Embodiment 1

Figure 1:
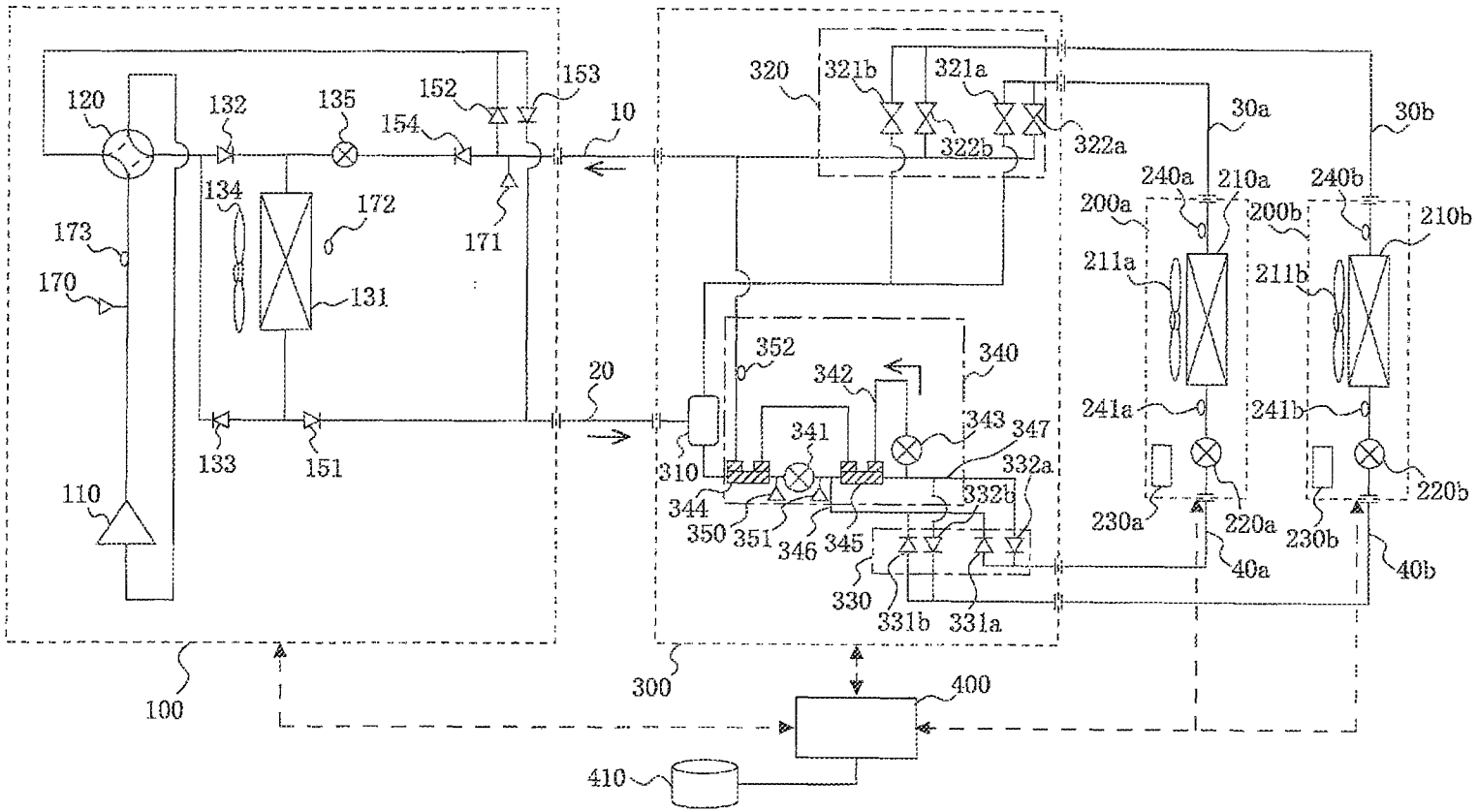
FIG. 1 is a diagram illustrating a configuration of an air-conditioning apparatus and a refrigerant circuit according to Embodiment 1 of the present invention.

FIG. 1 is a diagram illustrating an overall configuration of an air-conditioning apparatus according to Embodiment 1 of the present invention. In FIG. 1 and the figures to be referred to below, components denoted by the same reference symbols are the same or corresponding components, which holds true for the whole of the specification. In addition, the forms of the components described in the whole of the specification are merely illustrative, and are not intended to be limited to the described forms.

Referring first to FIG. 1, means (devices) and the like constructing the air-conditioning apparatus are described. The air-conditioning apparatus performs cooling and heating operations by using a refrigeration cycle (heat pump cycle) obtained by a refrigerant cycle. In particular, the air-conditioning apparatus in this embodiment is an apparatus capable of performing a simultaneous cooling and heating operation in which cooling and heating are simultaneously performed by each of a plurality of indoor units in a mixed manner.

As illustrated in FIG. 1, the air-conditioning apparatus in this embodiment mainly includes a heat source unit (heat source side unit, outdoor unit) 100, a plurality of indoor units (load-side units) 200*a* and 200*b*, and a relay unit 300. In Embodiment 1, the relay unit 300 is provided between the heat source unit 100 and the indoor units 200*a* and 200*b* in order to control the flow of refrigerant. Those devices are connected by piping with various kinds of refrigerant pipes. Further, the plurality of indoor units 200*a* and 200*b* are connected in parallel to each other. Note that, for example, the indoor units 200*a* and 200*b* are hereinafter described with the suffixes "a" and "b" omitted unless otherwise required to be distinguished or specified. Further, the other devices, temperature detectors, flow rate control devices, and the like are also sometimes hereinafter described with the suffixes "a" and "b" omitted unless otherwise required to be distinguished or specified.

In the piping connection, a first main pipe 10 and a second main pipe 20 that is smaller in pipe diameter than the first main pipe 10 are used to connect the heat source unit 100 and the relay unit 300 to each other. In the first main pipe 10, a low-pressure refrigerant flows from the relay unit 300 side to the heat source unit 100 side. Further, in the second main pipe 20, refrigerant having a pressure higher than that of the refrigerant flowing through the first main pipe 10 flows from the heat source unit 100 side to the relay unit 300 side. In this case, the magnitude difference in pressure is not determined by the relationship with a reference pressure (numerical value), but is expressed based on a relative magnitude difference (including an intermediate level) in a refrigerant circuit through pressurization by a compressor 110, control of an opening and closing state (opening degree) of each flow rate control device, and the like (The same holds true below. The same holds true for the magnitude difference in temperature. Basically, the pressure of the refrigerant discharged from the compressor 110 is the highest, and the pressure is reduced by the flow rate control devices and the like, and hence the pressure of the refrigerant sucked into the compressor 110 is the lowest).

Meanwhile, the relay unit 300 and the indoor unit 200*a* are connected to each other by a first branch pipe 30*a* and a second branch pipe 40*a*. Similarly, the relay unit 300 and the indoor unit 200*b* are connected to each other by a first branch pipe 30*b* and a second branch pipe 40*b*. The refrigerant circulates among the heat source unit 100, the relay unit 300, and the indoor unit 200 (200*a*, 200*b*) via the piping connection of the first main pipe 10, the second main pipe 20, the second branch pipe 40 (40*a*, 40*b*), and the first branch pipe 30 (30*a*, 30*b*), to thereby construct the refrigerant circuit.

The heat source unit 100 in Embodiment 1 includes the compressor 110, a four-way switching valve 120, a heat source unit-side heat exchanger 131, a first heat source unit-side check valve 132, a second heat source unit-side check valve 133, a heat source unit-side fan 134, a heat source unit-side flow rate control device 135, a third heat source unit-side check valve 151, a fourth heat source unit-side check valve 152, a fifth heat source unit-side check valve 153, and a sixth heat source unit-side check valve 154.

The compressor 110 of the heat source unit 100 discharges (sends out) the sucked refrigerant after pressurizing the refrigerant. In this case, the compressor 110 in Embodiment 1 is capable of arbitrarily changing a driving frequency thereof with use of an inverter circuit (not shown) based on an instruction from a controller 400. Thus, the compressor 110 serves as an inverter compressor as a whole, which is capable of changing a discharge capacity (the discharge amount of the refrigerant per unit time) and a capacity in accordance with the discharge capacity.

The four-way switching valve 120 performs valve switching corresponding to a mode of cooling and heating based on an instruction from the controller 400 so as to switch a passage of the refrigerant. In Embodiment 1, the four-way switching valve 120 switches the passage for a cooling only operation (in this case, refers to an operation in which all the indoor units in operation perform cooling) and a cooling main operation (cooling is main in the simultaneous cooling and heating operation) and for a heating only operation (in this case, refers to an operation in which all the indoor units in operation perform heating) and a heating main operation (heating is main in the simultaneous cooling and heating operation).

The heat source unit-side heat exchanger 131 includes a heat transfer tube through which refrigerant passes and a fin (not shown) for increasing a heat transfer area between the refrigerant flowing through the heat transfer tube and the outside air, and exchanges heat between the refrigerant and the air (outside air). For example, the heat source unit-side heat exchanger 131 functions as an evaporator in the heating only operation and the heating main operation so as to evaporate the refrigerant to be gasified. Meanwhile, the heat source unit-side heat exchanger 131 functions as a condenser in the cooling only operation and the cooling main operation so as to condense the refrigerant to be liquefied. In some cases, as exemplified in the cooling main operation, adjustment may be performed so that the refrigerant is not completely gasified or liquefied but is condensed to the state of two-phase mixture of a liquid and a gas (two-phase gas-liquid refrigerant).

Then, the heat source unit-side fan 134 for efficiently exchanging heat between the refrigerant and the air is provided in the vicinity of the heat source unit-side heat exchanger 131. The heat source unit-side fan 134 is capable of changing the volume of air based on an instruction from the controller 400, and a heat exchange capacity in the heat source unit-side heat exchanger 131 can be changed also through the change in air volume. Further, the heat source unit-side flow rate control device 135 controls, based on an instruction from the controller 400, the flow rate of the refrigerant that passes therethrough (the amount of the refrigerant flowing per unit time), to thereby adjust the pressure of the refrigerant passing through the heat source unit-side heat exchanger 131.

Each of the first heat source unit-side check valve 132, the second heat source unit-side check valve 133, the heat source unit-side fan 134, the heat source unit-side flow rate control device 135, the third heat source unit-side check valve 151, the fourth heat source unit-side check valve 152, the fifth heat source unit-side check valve 153, and the sixth heat source unit-side check valve 154 prevents the backflow of the refrigerant so as to control the flow of the refrigerant, to thereby maintain a constant circulation passage of the refrigerant suitable for the mode.

The first heat source unit-side check valve 132 is located on the pipe between the four-way switching valve 120 and the heat source unit-side heat exchanger 131, and permits the circulation of the refrigerant in the direction from the four-way switching valve 120 to the heat source unit-side heat exchanger 131.

The second heat source unit-side check valve 133 is located on the pipe between the heat source unit-side heat exchanger 131 and the four-way switching valve 120, and permits the circulation of the refrigerant in the direction from the heat source unit-side heat exchanger 131 to the four-way switching valve 120.

The third heat source unit-side check valve 151 is located on the pipe between the heat source unit-side heat exchanger 131 and the second main pipe 20, and permits the circulation of the refrigerant in the direction from the heat source unit-side heat exchanger 131 to the second main pipe 20.

The fourth heat source unit-side check valve 152 is located on the pipe between the four-way switching valve 120 and the first main pipe 10, and permits the circulation of the refrigerant in the direction from the first main pipe 10 to the four-way switching valve 120.

The fifth heat source unit-side check valve 153 is located on the pipe between the four-way switching valve 120 and the second main pipe 20, and permits the circulation of the refrigerant in the direction from the four-way switching valve 120 to the second main pipe 20.

The sixth heat source unit-side check valve 154 is located on the pipe between the heat source unit-side heat exchanger 131 and the first main pipe 10, and permits the circulation of the refrigerant in the direction from the first main pipe 10 to the heat source unit-side heat exchanger 131.

Further, in Embodiment 1, on the pipe connected to the discharge side of the compressor 110, a first heat source unit-side pressure detector 170 serving as a pressure sensor for detecting the pressure of the refrigerant relating to the discharge and a first heat source unit-side temperature detector 173 serving as a temperature sensor for detecting the temperature of the refrigerant relating to the discharge are mounted. Based on signals from the first heat source unit-side pressure detector 170 and the first heat source unit-side temperature detector 173, the controller 400 detects, for example, a discharge pressure Pd and a discharge temperature Td of the refrigerant discharged by the compressor 110, and calculates a condensing temperature Tc and the like based on the discharge pressure Pd. In addition, on a pipe connecting the heat source unit 100 and the first main pipe 10 to each other, a second heat source unit-side pressure detector 171 for detecting the pressure of the refrigerant flowing into the pipe from the relay unit 300 side (corresponding to the indoor unit 200 side) is mounted. Further, an outside air temperature detector 172 for detecting the temperature of the outside air (outside air temperature) is mounted to the heat source unit 100.

Next, the relay unit 300 in Embodiment 1 includes a relay unit-side gas-liquid separation device 310, a first branch section 320, a second branch section 330, and a relay unit-side heat exchange section 340. The relay unit-side gas-liquid separation device 310 separates the refrigerant flowing from the second main pipe 20 into a gas refrigerant and a liquid refrigerant. In the relay unit-side gas-liquid separation device 310, a gas phase section (not shown) from which the gas refrigerant flows out is connected to the first branch section 320. Meanwhile, in the relay unit-side gas-liquid separation device 310, a liquid phase section (not shown) from which the liquid refrigerant flows out is connected to the second branch section 330 via the relay unit-side heat exchange section 340. A pipe for guiding the liquid refrigerant, which has flown out from the liquid phase section of the relay unit-side gas-liquid separation device 310, to the second branch section 330 via the relay unit-side heat exchange section 340 is hereinafter sometimes referred to as "pipe 347".

The first branch section 320 includes a first relay unit-side solenoid valve 321 (321*a*, 321*b*) and a second relay unit-side solenoid valve 322 (322*a*, 322*b*). Each first relay unit-side solenoid valve 321 connects the gas phase section side of the relay unit-side gas-liquid separation device 310 and each first branch pipe 30 (30*a*, 30*b*) to each other. Each second relay unit-side solenoid valve 322 connects each first branch pipe 30 and the first main pipe 10 to each other. The first relay unit-side solenoid valve 321 and the second relay unit-side solenoid valve 322 switch the passage based on an instruction from the controller 400 so that the refrigerant may flow from the indoor unit 200 side to the first main pipe 10 side or so that the refrigerant may flow from the relay unit-side gas-liquid separation device 310 side to the indoor unit 200 side.

The second branch section 330 includes a first relay unit-side check valve 331 (331*a*, 331*b*) and a second relay unit-side check valve 332 (332*a*, 332*b*). The first relay unit-side check valve 331 and the second relay unit-side check valve 332 have an anti-parallel relationship. One end of each of the check valves is connected to the second branch pipe 40 (40*a*, 40*b*). When the refrigerant flows from the indoor unit 200 side to the relay unit-side heat exchange section 340 side, the refrigerant passes through the first relay unit-side check valve 331 to flow to a second relay unit-side bypass pipe 346 of the relay unit-side heat exchange section 340. Further, when the refrigerant flows from the relay unit-side heat exchange section 340 side to the indoor unit 200 side, the refrigerant passes through the second relay unit-side check valve 332.

The relay unit-side heat exchange section 340 includes a first relay unit-side flow rate control device 341, a first relay unit-side bypass pipe 342, a second relay unit-side flow rate control device (bypass flow rate control device) 343, a first relay unit-side heat exchanger 344, a second relay unit-side heat exchanger 345, and the second relay unit-side bypass pipe 346. The first relay unit-side bypass pipe 342 is arranged so as to branch from a portion between the second relay unit-side heat exchanger 345 and the second relay unit-side check valve 332 to be connected to the first main pipe 10 via the second relay unit-side flow rate control device 343, the second relay unit-side heat exchanger 345, and the first relay unit-side heat exchanger 344.

For example, in the cooling only operation, the relay unit-side heat exchange section 340 subcools a liquid refrigerant to supply the subcooled refrigerant to the indoor unit 200 side. Further, the relay unit-side heat exchange section 340 is connected by piping to the first main pipe 10, and causes the refrigerant flowing from the indoor unit 200 side (refrigerant used for subcooling) to flow to the first main pipe 10.

The first relay unit-side flow rate control device 341 is provided on the pipe 347 between the first relay unit-side heat exchanger 344 and the second relay unit-side heat exchanger 345. The first relay unit-side flow rate control device 341 controls an opening degree thereof based on an instruction from the controller 400 to adjust the flow rate and the pressure of the refrigerant flowing from the relay unit-side gas-liquid separation device 310.

Meanwhile, the second relay unit-side flow rate control device 343 controls an opening degree thereof based on an instruction from the controller 400 to adjust the flow rate and the pressure of the refrigerant passing through the first relay unit-side bypass pipe 342. In this case, the opening degree of the second relay unit-side flow rate control device 343 in Embodiment 1 is determined by the controller 400 based on a differential pressure between a pressure detected by a first relay unit-side pressure detector 350 and a pressure detected by a second relay unit-side pressure detector 351. In other words, the opening degree of the second relay unit-side flow rate control device 343 is controlled so as to secure the differential pressure. Further, the opening degree of the second relay unit-side flow rate control device 343 is controlled also in order to reduce the discharge temperature of the high-pressure gas refrigerant discharged from the compressor 110. Details thereof are described later.

When the differential pressure is secured in this manner, a desired refrigerant can be caused to flow to the indoor unit 200. In a multi-air-conditioning apparatus for a building, if a differential pressure equal to or higher than a total differential pressure of a permissible height difference (liquid head) and a pressure loss in an extended pipe from the relay unit 300 to the indoor unit 200 is not secured, the refrigerant is not supplied to the indoor unit 200. Accordingly, the opening degree of the second relay unit-side flow rate control device 343 is controlled so that the differential pressure may be equal to or higher than a predetermined differential pressure (for example, 0.3 MPa).

The refrigerant flowing into the first relay unit-side bypass pipe 342 passes through the second relay unit-side flow rate control device 343. Then, the refrigerant subcools refrigerant flowing through the pipe 347 at, for example, the second relay unit-side heat exchanger 345 and the first relay unit-side heat exchanger 344, and flows to the first main pipe 10.

The second relay unit-side heat exchanger 345 exchanges heat between the refrigerant that flows through the first relay unit-side bypass pipe 342 at the downstream portion of the second relay unit-side flow rate control device 343 (the refrigerant that has passed through the second relay unit-side flow rate control device 343) and the refrigerant in the pipe

347 that has passed through the first relay unit-side flow rate control device 341. Further, the first relay unit-side heat exchanger 344 exchanges heat between the refrigerant that has passed through the second relay unit-side heat exchanger 345 from the first relay unit-side bypass pipe 342 and the refrigerant that has flown out from the relay unit-side gas-liquid separation device 310 to flow into the pipe 347 (the refrigerant directed to the first relay unit-side flow rate control device 341).

In addition, the second relay unit-side bypass pipe 346 causes the refrigerant that has passed through the first relay unit-side check valve 331 from the indoor unit 200 to flow therethrough. For example, in the cooling main operation and the heating main operation, the refrigerant that has passed through the second relay unit-side bypass pipe 346 passes through the second relay unit-side heat exchanger 345, for example, and then a part or whole of the refrigerant flows to the indoor unit 200 that is performing cooling. Further, for example, in the heating only operation, the refrigerant that has passed through the second relay unit-side bypass pipe 346 passes through the second relay unit-side heat exchanger 345, and then a whole of the refrigerant passes through the first relay unit-side bypass pipe 342 to flow to the first main pipe 10.

Further, in the relay unit 300, in order to detect the pressures of the refrigerant before and after the passage through the first relay unit-side flow rate control device 341, the first relay unit-side pressure detector 350 is mounted on the pipe connecting the first relay unit-side flow rate control device 341 and the relay unit-side gas-liquid separation device 310 to each other, and the second relay unit-side pressure detector 351 is mounted on the pipe connecting the first relay unit-side flow rate control device 341 and the second branch section 330 to each other. As described above, based on the difference of the pressures detected by the first relay unit-side pressure detector 350 and the second relay unit-side pressure detector 351, the controller 400 determines the opening degree of the second relay unit-side flow rate control device 343 and instructs the second relay unit-side flow rate control device 343 to have the determined opening degree. In addition, a relay unit-side temperature detector 352 is mounted on the pipe connecting the first main pipe 10 and the first relay unit-side heat exchanger 344 to each other. The controller 400 determines the pressure of the refrigerant flowing from the indoor unit 200 side to the first main pipe 10 side by calculation or the like based on, for example, the signal from the relay unit-side temperature detector 352.

Next, the configuration of the indoor unit 200 (200*a*, 200*b*) is described. The indoor unit 200 includes an indoor unit-side heat exchanger 210 (210*a*, 210*b*), an indoor unit-side flow rate control device 220 (220*a*, 220*b*) connected in series to the indoor unit-side heat exchanger 210 so as to be close thereto, and an indoor unit-side controller 230 (230*a*, 230*b*). The indoor unit-side heat exchanger 210 functions as an evaporator for cooling and as a condenser for heating, to thereby exchange heat between the air in the air-conditioned space and the refrigerant. Further, an indoor unit-side fan 211 (211*a*, 211*b*) for efficiently exchanging heat between the refrigerant and the air is provided in the vicinity of each indoor unit-side heat exchanger 210.

The indoor unit-side flow rate control device 220 functions as a pressure reducing valve or an expansion valve to adjust the pressure of the refrigerant that passes through the indoor unit-side heat exchanger 210. In this case, the indoor unit-side flow rate control device 220 in Embodiment 1 is constructed by, for example, an electronic expansion valve capable of changing the opening degree thereof. Then, the opening degree of the indoor unit-side flow rate control device 220 in cooling is determined by, for example, the indoor unit-side controller 230 included in each indoor unit 200 based on the degree of superheat of the indoor unit-side heat exchanger 210 on the refrigerant outlet side (in this case, the first branch pipe 30 side). Further, the opening degree of the indoor unit-side flow rate control device 220 in heating is determined based on the degree of subcooling of the indoor unit-side heat exchanger 210 on the refrigerant outlet side (in this case, the second branch pipe 40 side). The indoor unit-side controller 230 controls the operation of each means of the indoor unit 200.

Further, the indoor unit-side controller 230 communicates signals containing various kinds of data to and from the controller 400 in a wired or wireless manner, and processes the signals. In this case, for example, the indoor unit-side controller 230 includes storage means (not shown), and stores data on a heat exchange capacity in the cooling operation or the heating operation, which is determined by the size (heat transfer area and the like) of the indoor unit-side heat exchanger 210 and the air volume from the indoor unit-side fan 211 (the size of the indoor unit-side heat exchanger 210 is fixed for each indoor unit 200, and hence the heat exchange capacity substantially differs depending on the change in air volume).

Now, the heat exchange capacity of the indoor unit-side heat exchanger 210 relating to the heating operation is represented by Qjh, and the heat exchange capacity of the indoor unit-side heat exchanger 210 relating to the cooling operation is represented by Qjc. Based on an instruction from an operator who is indoors, which is input via a remote controller (not shown), the indoor unit-side controller 230 determines whether the current operation is the cooling operation or the heating operation, the instructed air volume, and the like, and transmits a signal containing data on the heat exchange capacity to the controller 400.

A first indoor unit-side temperature detector 240 (240*a*, 240*b*) and a second indoor unit-side temperature detector 241 (241*a*, 241*b*) are mounted to a pipe serving as a flow inlet or a flow outlet for the refrigerant in the indoor unit-side heat exchanger 210 of each indoor unit 200. Based on a difference between the temperature detected by the first indoor unit-side temperature detector 240 and the temperature detected by the second indoor unit-side temperature detector 241, each indoor unit-side controller 230 calculates the degree of superheat or the degree of subcooling, and determines the opening degree of each indoor unit-side flow rate control device 220.

The controller 400 makes a determination and other such processing based on signals transmitted from, for example, various kinds of detectors (sensors) provided inside and outside the air-conditioning apparatus and the respective devices of the air-conditioning apparatus. Then, the controller 400 has a function of operating the respective devices based on the determination so as to control the overall operation of the air-conditioning apparatus in a comprehensive manner. Specifically, the controller 400 controls a driving frequency of the compressor 110, controls an opening degree of the flow rate control device such as the heat source unit-side flow rate control device 135, and controls the switching of the four-way switching valve 120, the first relay unit-side solenoid valve 321, and the like. The storage device 410 stores various kinds of data, programs, and the like necessary for the controller 400 to perform processing on a temporary or long-term basis.

In this case, in Embodiment 1, the controller 400 and the storage device 410 are provided independently from the heat source unit 100. For example, however, the controller 400 and the storage device 410 are provided in the heat source unit 100 in many cases. Further, the controller 400 and the storage device 410 are provided in the vicinity of the air-conditioning apparatus, but, for example, the air-conditioning apparatus may be controlled remotely by signal communications through a public telecommunication network or the like.

The air-conditioning apparatus according to Embodiment 1 configured in the above-mentioned manner is capable of performing any one of the four modes of cooling only operation, heating only operation, cooling main operation, and heating main operation as described above. In this case, the heat source unit-side heat exchanger 131 of the heat source unit 100 functions as a condenser in the cooling only operation and the cooling main operation, and functions as an evaporator in the heating only operation and the heating main operation. Next, the basic operation of each device and the flow of refrigerant in the operation in each mode are described.

<<Cooling Only Operation>>

Figure 2:
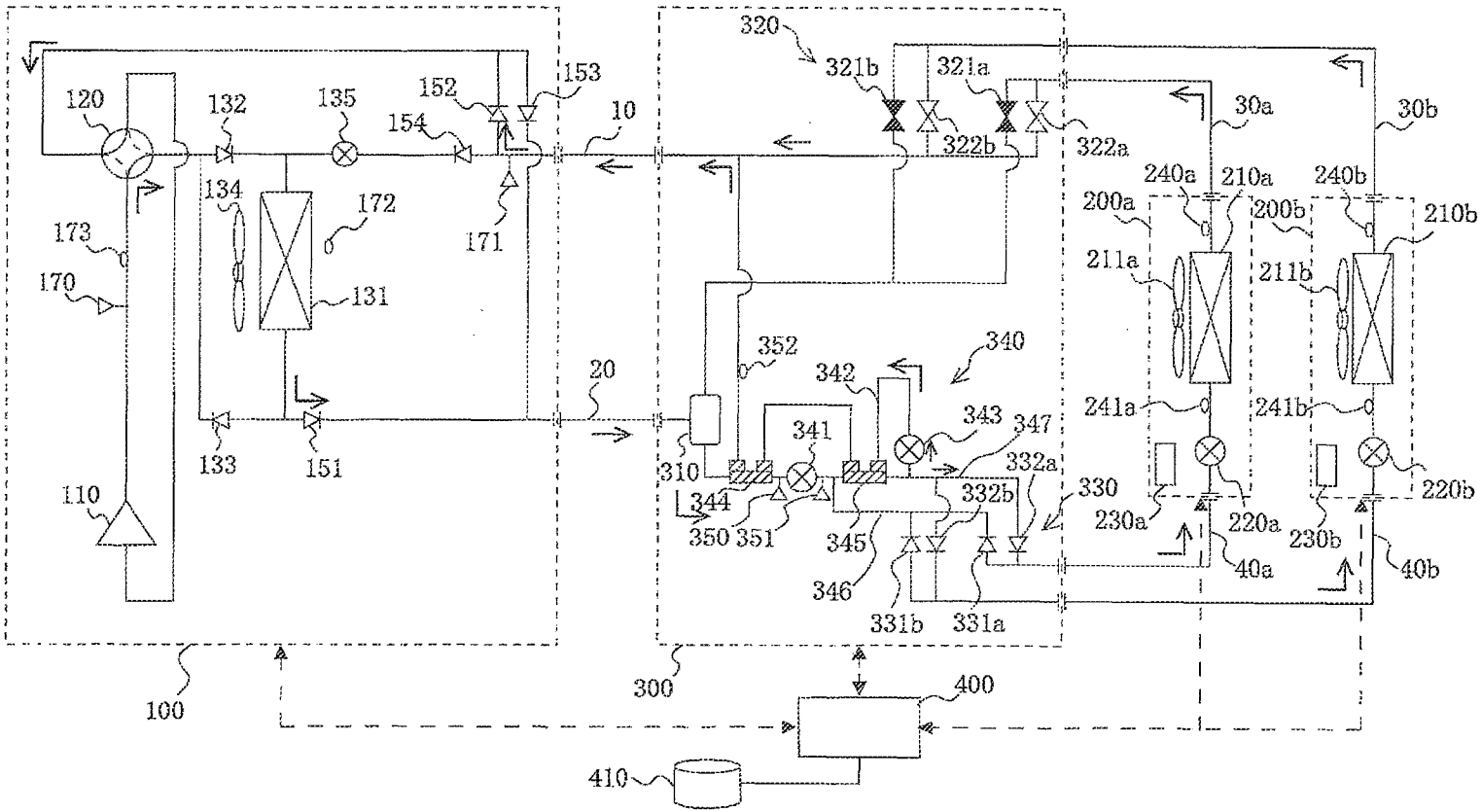
FIG. 2 is a diagram illustrating the flow of refrigerant in a cooling only operation according to Embodiment 1 of the present invention.

FIG. 2 is a diagram illustrating the flow of the refrigerant in the cooling only operation of the air-conditioning apparatus according to Embodiment 1 of the present invention. Note that, in FIG. 2, the first relay unit-side solenoid valve 321 and the second relay unit-side solenoid valve 322 are illustrated in black for the closed state and in white for the open state. This representation holds true for the figures to be referred to below. First, the operation of each device and the flow of the refrigerant in the cooling only operation are described with reference to FIG. 2. The flow of the refrigerant in the cooling only operation is indicated by the solid line arrows in FIG. 2. Now, the case where all the indoor units 200 perform cooling without stopping is described.

In the heat source unit 100, the compressor 110 compresses a sucked refrigerant so as to discharge a high-pressure gas refrigerant. The high-pressure gas refrigerant discharged from the compressor 110 flows to the heat source unit-side heat exchanger 131 through the four-way switching valve 120. While the high-pressure gas refrigerant passes through the heat source unit-side heat exchanger 131, the high-pressure gas refrigerant is condensed through heat exchange with the outside air to be a high-pressure liquid refrigerant, and the high-pressure liquid refrigerant flows through the third heat source unit-side check valve 151 (does not flow to the fifth heat source unit-side check valve 153 side or the sixth heat source unit-side check valve 154 side due to the relationship of the pressure of the refrigerant). Then, the high-pressure liquid refrigerant flows into the relay unit 300 through the second main pipe 20.

The refrigerant flowing into the relay unit 300 is separated by the relay unit-side gas-liquid separation device 310 into a gas refrigerant and a liquid refrigerant. In this case, the refrigerant that flows into the relay unit 300 in the cooling only operation is the liquid refrigerant. Further, because the controller 400 closes the first relay unit-side solenoid valve 321 (321*a*, 321*b*) of the first branch section 320, the gas refrigerant does not flow from the relay unit-side gas-liquid separation device 310 to the indoor unit 200 (200*a*, 200*b*) side. Meanwhile, the liquid refrigerant obtained by the separation in the relay unit-side gas-liquid separation device 310 flows into the pipe 347 to pass through the first relay unit-side heat exchanger 344, the first relay unit-side flow rate control device 341, and the second relay unit-side heat exchanger 345, and a part thereof flows into the second branch section 330. The refrigerant flowing into the second branch section 330 branches to the indoor units 200*a* and 200*b* through the second relay unit-side check valves 332*a* and 332*b* and the second branch pipes 40*a* and 40*b*.

In the indoor units 200*a* and 200*b*, the pressures of the respective liquid refrigerants flowing from the second branch pipes 40*a* and 40*b* are adjusted through adjustment of the opening degrees of the indoor unit-side flow rate control devices 220*a* and 220*b*. In this case, as described above, the opening degree of each indoor unit-side flow rate control device 220 is adjusted based on the degree of superheat of each indoor unit-side heat exchanger 210 on the refrigerant outlet side. Refrigerants turned into low-pressure liquid refrigerants or two-phase gas-liquid refrigerants through the adjustment of the opening degrees of the respective indoor unit-side flow rate control devices 220*a* and 220*b* flow to the indoor unit-side heat exchangers 210*a* and 210*b*, respectively.

The low-pressure liquid refrigerants or two-phase gas-liquid refrigerants are evaporated through heat exchange with the indoor air in the air-conditioned space while passing through the indoor unit-side heat exchangers 210*a* and 210*b*, respectively, to be low-pressure gas refrigerants. At this time, the indoor air is cooled through the heat exchange to perform cooling of the indoor space. Then, the respective low-pressure gas refrigerants flow out from the indoor unit-side heat exchangers 210*a* and 210*b* to flow through the first branch pipes 30*a* and 30*b*. Note that, in the above description, the refrigerants flowing out from the indoor unit-side heat exchangers 210*a* and 210*b* are the gas refrigerants, but, for example, in the case where an air conditioning load in each indoor unit 200 (the amount of heat necessary for the indoor unit; hereinafter referred to as "load") is small or in the case of a transient state immediately after the start of operation, the refrigerants may not completely gasified by the indoor unit-side heat exchangers 210*a* and 210*b* but two-phase gas-liquid refrigerants may flow out. The low-pressure gas refrigerants or two-phase gas-liquid refrigerants (low-pressure refrigerants) flowing from the first branch pipes 30*a* and 30*b* pass through the second relay unit-side solenoid valves 322*a* and 322*b* to flow to the first main pipe 10.

The refrigerant flowing to the heat source unit 100 after passing through the first main pipe 10 returns to the compressor 110 again through the fourth heat source unit-side check valve 152 and the four-way switching valve 120, to thereby circulate. This is a circulating passage for the refrigerant in the cooling only operation.

Now, the flow of the refrigerant in the relay unit-side heat exchange section 340 is described. As described above, the liquid refrigerant obtained by the separation in the relay unit-side gas-liquid separation device 310 passes through the first relay unit-side heat exchanger 344, the first relay unit-side flow rate control device 341, and the second relay unit-side heat exchanger 345, and a part thereof flows into the second branch section 330. Meanwhile, the refrigerant that has not flown to the second branch section 330 side flows into the first relay unit-side bypass pipe 342 to be depressurized by the second relay unit-side flow rate control device 343.

The refrigerant depressurized by the second relay unit-side flow rate control device 343 subcools refrigerant flowing through the pipe 347 at each of the second relay unit-side heat exchanger 345 and the first relay unit-side heat exchanger 344, and thereafter flows into the first main pipe 10. Specifically, the liquid refrigerant obtained by the separation in the relay unit-side gas-liquid separation device 310 and directed to the indoor unit 200 through the pipe 347 is subcooled in the relay unit-side heat exchange section 340, and thereafter flows into the second branch section 330. With this, the enthalpy on the refrigerant inlet side of the indoor units 200*a* and 200*b* (in this case, on the second branch pipe 40 side) can be reduced to increase the amount of heat exchange with the air in the indoor unit-side heat exchangers 210*a* and 210*b*.

In this case, when the opening degree of the second relay unit-side flow rate control device 343 is large and the amount of the refrigerant flowing through the first relay unit-side bypass pipe 342 (the refrigerant used for subcooling) is increased, the amount of the refrigerant not to be evaporated is increased in the first relay unit-side bypass pipe 342. Accordingly, the refrigerant that has passed through the first relay unit-side heat exchanger 344 becomes a two-phase gas-liquid refrigerant rather than a gas refrigerant in the first relay unit-side bypass pipe 342, and the two-phase gas-liquid refrigerant flows into the heat source unit 100 side through the first main pipe 10.

<<Cooling Main Operation>>

Figure 3:
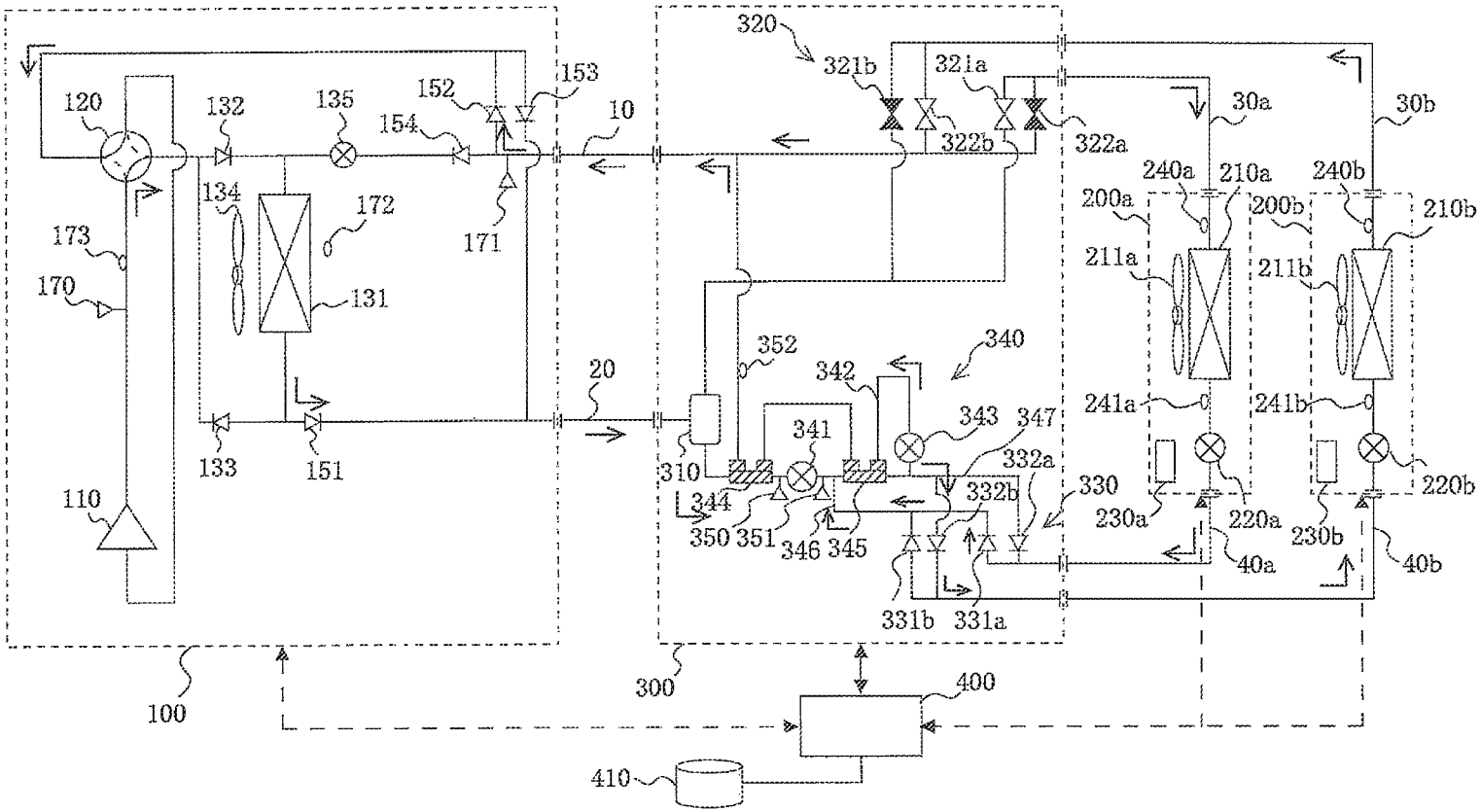
FIG. 3 is a diagram illustrating the flow of refrigerant in a cooling main operation according to Embodiment 1 of the present invention.

FIG. 3 is a diagram illustrating the flow of the refrigerant in the cooling main operation of the air-conditioning apparatus according to Embodiment 1 of the present invention. The following description is predetermined of the case where the indoor unit 200*b* performs cooling and the indoor unit 200*a* performs heating. The flow of the refrigerant in the cooling main operation is indicated by the solid line arrows in FIG. 3. The operation of each device included in the heat source unit 100 and the flow of the refrigerant are the same as those in the cooling only operation described above with reference to FIG. 2. In the cooling main operation, however, the refrigerant flowing into the relay unit 300 through the second main pipe 20 is turned into a two-phase gas-liquid refrigerant through control of condensation of the refrigerant in the heat source unit-side heat exchanger 131. In the following, the indoor unit 200*b* that performs cooling is referred to as "cooling indoor unit 200*b*", and the indoor unit 200*a* that performs heating is referred to as "heating indoor unit 200*a*". The same holds true for the other operations to be described later.

Further, the flow of the refrigerant that flows out from the heat source unit 100 to pass through the second main pipe 20, that reaches the cooling indoor unit 200*b* through the relay unit-side heat exchange section 340 and the second branch section 330, and that passes through the first main pipe 10 to flow into the heat source unit 100 is the same as the flow in the cooling only operation described above with reference to FIG. 2. Meanwhile, the flow of the refrigerant relating to the heating indoor unit 200*a* differs from that relating to the cooling indoor unit 200*b*. First, the relay unit-side gas-liquid separation device 310 separates the two-phase gas-liquid refrigerant flowing into the relay unit 300 into a gas refrigerant and a liquid refrigerant. The controller 400 closes the first relay unit-side solenoid valve 321*b* of the first branch section 320 so that the gas refrigerant obtained by the separation in the relay unit-side gas-liquid separation device 310 may not flow to the indoor unit 200*b* side. Meanwhile, the controller 400 opens the first relay unit-side solenoid valve 321*a* so that the gas refrigerant obtained by the separation in the relay unit-side gas-liquid separation device 310 may flow to the heating indoor unit 200*a* side through the first branch pipe 30*a*.

In the heating indoor unit 200*a*, the opening degree of the indoor unit-side flow rate control device 220*a* is adjusted so that, in regard to a high-pressure gas refrigerant flowing from the first branch pipe 30*a*, the pressure of the refrigerant flowing in the indoor unit-side heat exchanger 210*a* may be adjusted. Then, the high-pressure gas refrigerant is condensed to be a liquid refrigerant through heat exchange while passing through the indoor unit-side heat exchanger 210*a*, and the liquid refrigerant passes through the indoor unit-side flow rate control device 220*a*. At this time, the indoor air is heated through the heat exchange in the indoor unit-side heat exchanger 210*a* to perform heating in the indoor space. The refrigerant passing through the indoor unit-side flow rate control device 220*a* becomes a liquid refrigerant with the slightly reduced pressure, and flows through the second relay unit-side bypass pipe 346 through the second branch pipe 40*a* and the first relay unit-side check valve 331*a*. Then, the liquid refrigerant joins a liquid refrigerant flowing from the relay unit-side gas-liquid separation device 310 (a liquid refrigerant in the pipe 347 after passing through the first relay unit-side flow rate control device 341), and passes through the second relay unit-side heat exchanger 345 and the second relay unit-side check valve 332*b* to flow to the indoor unit 200*b*, which is then used as the refrigerant for cooling.

As described above, in the cooling main operation, the heat source unit-side heat exchanger 131 of the heat source unit 100 functions as a condenser. Further, the refrigerant passing through the indoor unit 200 that performs heating (in this case, the indoor unit 200*a*) is used as the refrigerant for the indoor unit 200 that performs cooling (in this case, the indoor unit 200*b*). In this case, when the load in the cooling indoor unit 200*b* is small and the refrigerant flowing to the cooling indoor unit 200*b* needs to be suppressed, the controller 400 increases the opening degree of the second relay unit-side flow rate control device 343 to reduce the amount of the refrigerant directed to the cooling indoor unit 200*b*. Consequently, the refrigerant can be caused to flow to the first main pipe 10 through the first relay unit-side bypass pipe 342 without supplying the refrigerant more than necessary to the cooling indoor unit 200*b*.

<<Heating Only Operation>>

Figure 4:
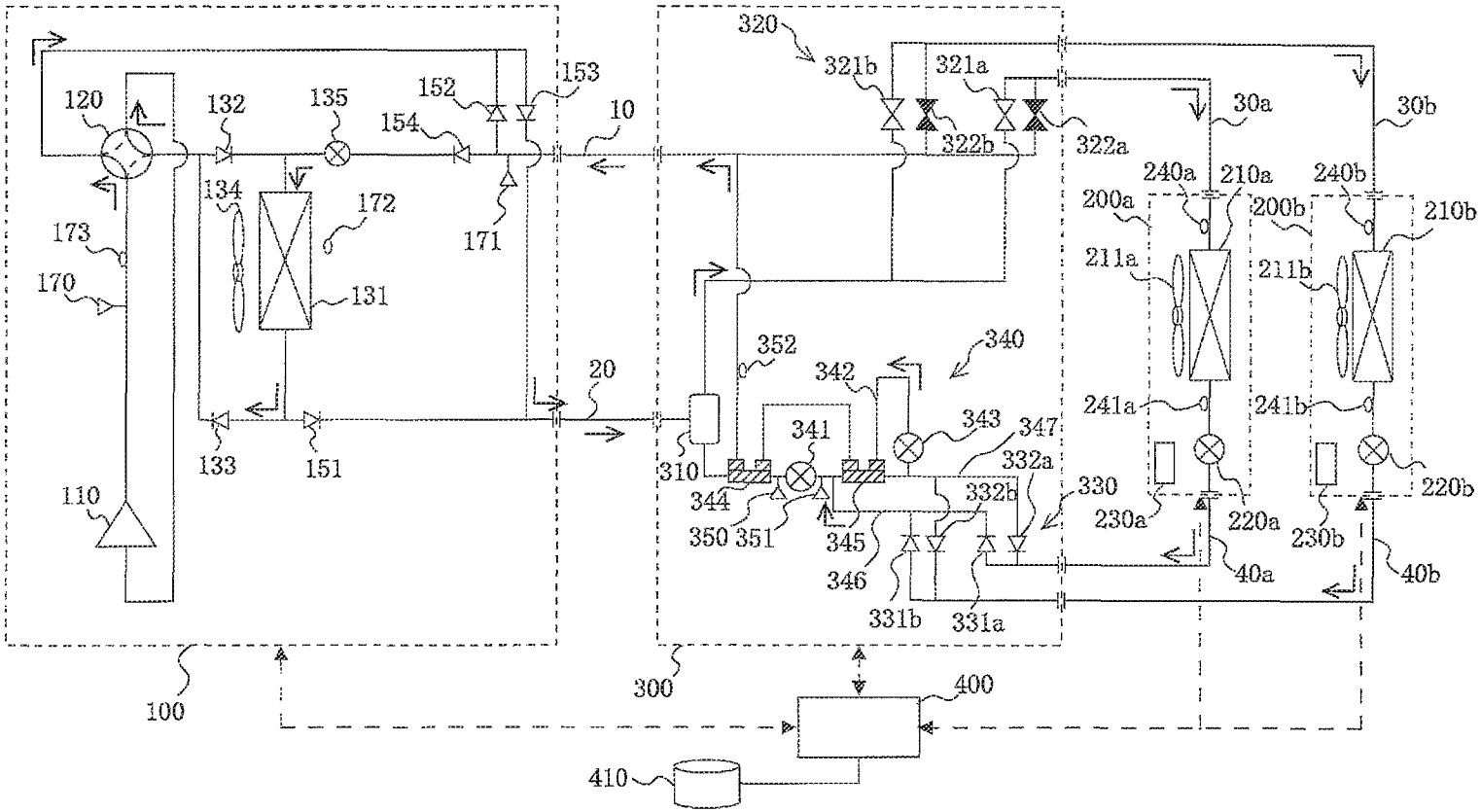
FIG. 4 is a diagram illustrating the flow of refrigerant in a heating only operation according to Embodiment 1 of the present invention.

FIG. 4 is a diagram illustrating the flow of the refrigerant in the heating only operation of the air-conditioning apparatus according to Embodiment 1 of the present invention. Next, the operation of each device and the flow of the refrigerant in the heating only operation are described. Now, the case where all the indoor units 200 perform heating without stopping is described. The flow of the refrigerant in the heating only operation is indicated by the solid line arrows in FIG. 4. In the heat source unit 100, the compressor 110 compresses a sucked refrigerant so as to discharge a high-pressure gas refrigerant. The refrigerant discharged by the compressor 110 flows through the four-way switching valve 120 and the fifth heat source unit-side check valve 153 (does not flow to the fourth heat source unit-side check valve 152 side or the third heat source unit-side check valve 151 side due to the relationship of the pressure of the refrigerant), and flows into the relay unit 300 through the second main pipe 20.

The refrigerant flowing into the relay unit 300 is separated by the relay unit-side gas-liquid separation device 310 into a gas refrigerant and a liquid refrigerant. The gas refrigerant obtained by the separation flows into the first branch section 320. In this case, the first branch section 320 branches the flowing refrigerant from the first relay unit-side solenoid valves 321 (321*a*, 321*b*) to all the indoor units 200*a* and 200*b* through the first branch pipes 30*a* and 30*b*.

In the indoor units 200*a* and 200*b*, the respective indoor unit-side controllers 230 adjust the opening degrees of the indoor unit-side flow rate control devices 220*a* and 220*b*.

With this, in regard to the high-pressure gas refrigerants flowing from the first branch pipes 30*a* and 30*b*, the pressures of the refrigerants flowing in the indoor unit-side heat exchangers 210*a* and 210*b* are adjusted. Then, the high-pressure gas refrigerants are condensed to be liquid refrigerants through heat exchange while passing through the indoor unit-side heat exchangers 210*a* and 210*b*, and the liquid refrigerants pass through the indoor unit-side flow rate control devices 220*a* and 220*b*. At this time, the indoor air is heated through the heat exchange in the indoor unit-side heat exchangers 210*a* and 210*b* to perform heating in the air-conditioned space (indoor).

The refrigerants passing through the indoor unit-side flow rate control devices 220*a* and 220*b* become low-pressure liquid refrigerants or two-phase gas-liquid refrigerants, and flow in the second relay unit-side bypass pipe 346 through the second branch pipes 40*a* and 40*b* and the first relay unit-side check valves 331*a* and 331*b*. In this case, the controller 400 closes the first relay unit-side flow rate control device 341 to interrupt the flow of the refrigerant between the second relay unit-side bypass pipe 346 and the relay unit-side gas-liquid separation device 310. Accordingly, the refrigerant passing through the second relay unit-side bypass pipe 346 passes on the high-pressure side of the second relay unit-side heat exchanger 345, and thereafter passes through the first relay unit-side bypass pipe 342 (that is, the second relay unit-side flow rate control device 343→the low-pressure side of the second relay unit-side heat exchanger 345→the first relay unit-side heat exchanger 344) to flow to the first main pipe 10.

In this case, the controller 400 adjusts the opening degree of the second relay unit-side flow rate control device 343 provided to the first relay unit-side bypass pipe 342, and hence a low-pressure two-phase gas-liquid refrigerant flows to the first main pipe 10. Note that, in the state in which the first relay unit-side flow rate control device 341 is closed, a high-pressure liquid refrigerant flows from the second relay unit-side bypass pipe 346 into the second relay unit-side heat exchanger 345, and hence heat is exchanged between the high-pressure liquid refrigerant and the refrigerant passing through the first relay unit-side bypass pipe 342.

The refrigerant flowing from the first main pipe 10 into the heat source unit 100 passes through the sixth heat source unit-side check valve 154 and the heat source unit-side flow rate control device 135 of the heat source unit 100, and flows into the heat source unit-side heat exchanger 131 functioning as an evaporator. The refrigerant flowing into the heat source unit-side heat exchanger 131 is evaporated to be a gas refrigerant through heat exchange with the air while passing through the heat source unit-side heat exchanger 131. Then, the gas refrigerant returns to the compressor 110 again through the four-way switching valve 120, and is compressed and discharged as described above, to thereby circulate. This is a circulating passage for the refrigerant in the heating only operation.

In the above description, all the indoor units 200*a* and 200*b* are operating in the cooling only operation and the heating only operation, but, for example, a part of the indoor units may be stopped. Further, for example, in the case where a part of the indoor units 200 is stopped and the load in the air-conditioning apparatus as a whole is small, the discharge capacity relating to the change in driving frequency of the compressor 110 may be changed to change the supply capacity.

<<Heating Main Operation>>

Figure 5:
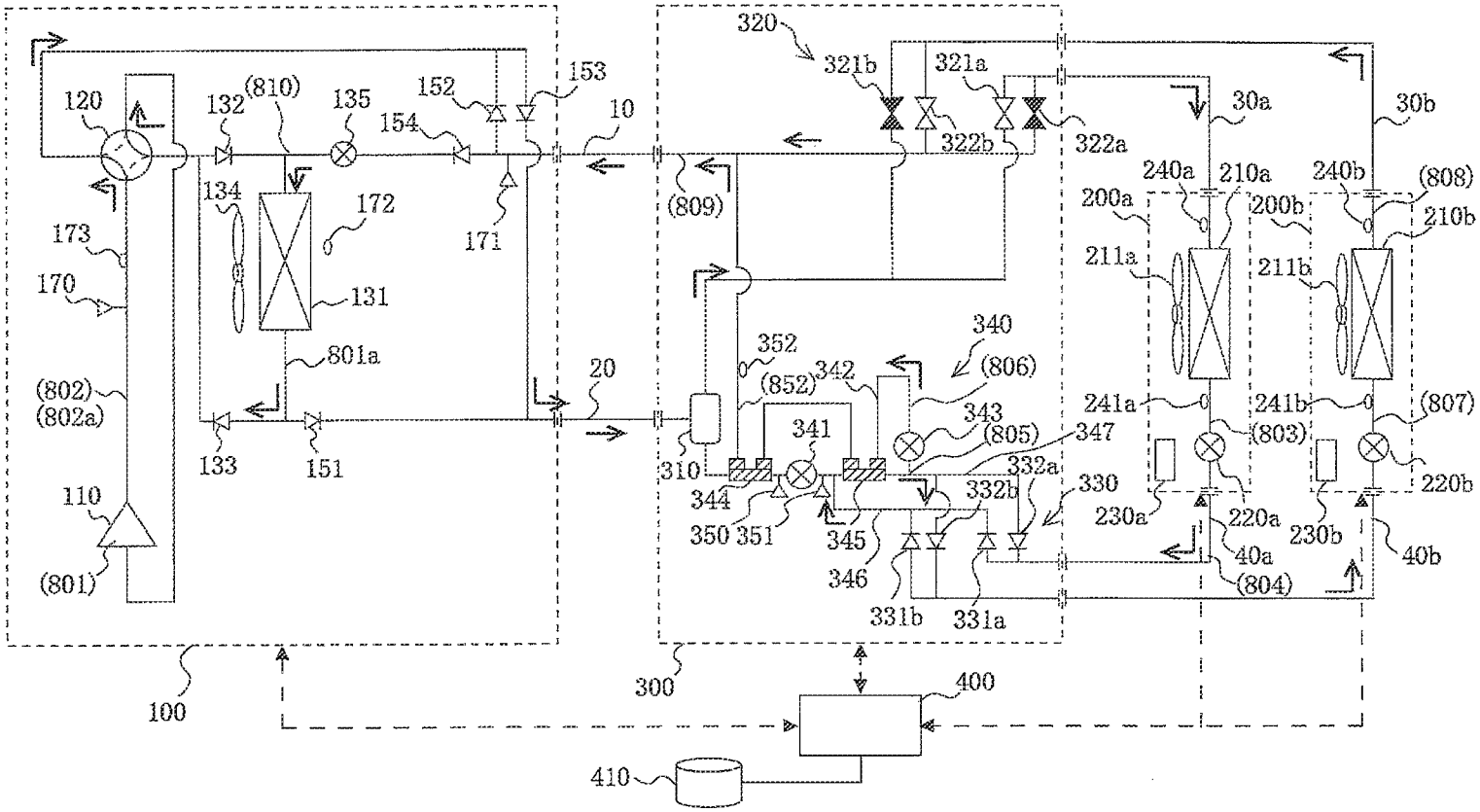
FIG. 5 is a diagram illustrating the flow of refrigerant in a heating main operation according to Embodiment 1 of the present invention.

FIG. 5 is a diagram illustrating the flow of the refrigerant in the heating main operation of the air-conditioning apparatus according to Embodiment 1 of the present invention. The following description is predetermined of the case where the indoor unit 200*a* performs heating and the indoor unit 200*b* performs cooling. The flow of the refrigerant in the heating main operation is indicated by the solid line arrows in FIG. 5. The operation of each device included in the heat source unit 100 and the flow of the refrigerant are the same as those in the heating only operation described above with reference to FIG. 4.

Further, the flow of the refrigerant in the heating indoor unit 200*a* in heating is the same as the flow in the heating only operation described above with reference to FIG. 4. In the heating indoor unit 200*a*, the refrigerant condensed through heat exchange while passing through the indoor unit-side heat exchanger 210*a* passes through the indoor unit-side flow rate control device 220*a* and the first relay unit-side check valve 331*a* to flow to the second relay unit-side bypass pipe 346.

Meanwhile, the flow of the refrigerant in the cooling indoor unit 200*b* differs from that in the heating indoor unit 200*a*. This flow of the refrigerant is described below.

In this case, similarly to the heating only operation, the controller 400 closes the first relay unit-side flow rate control device 341 to interrupt the flow of the refrigerant between the second relay unit-side bypass pipe 346 and the relay unit-side gas-liquid separation device 310. Accordingly, the refrigerant condensed by the indoor unit-side heat exchanger 210*a* and passing through the second relay unit-side bypass pipe 346 passes through the second relay unit-side heat exchanger 345, the second relay unit-side check valve 332*b*, and the second branch pipe 40*b* to flow into the cooling indoor unit 200*b*, to thereby serve as the refrigerant used for cooling.

In this case, the controller 400 adjusts the opening degree of the second relay unit-side flow rate control device 343 to supply a necessary amount of the refrigerant to the cooling indoor unit 200*b*, and causes the remaining amount of the refrigerant to flow to the first main pipe 10 through the first relay unit-side bypass pipe 342. Note that, in the state in which the first relay unit-side flow rate control device 341 is closed, a high-pressure liquid refrigerant flows from the second relay unit-side bypass pipe 346 into the second relay unit-side heat exchanger 345, and hence heat is exchanged between the high-pressure liquid refrigerant and the refrigerant passing through the first relay unit-side bypass pipe 342.

In the heating main operation, the refrigerant flowing out from the indoor unit that is performing heating (in this case, the indoor unit 200*a*) flows to the indoor unit that performs cooling (in this case, the indoor unit 200*b*). Accordingly, when the indoor unit 200*b* that performs cooling is stopped, the amount of the two-phase gas-liquid refrigerant flowing through the first relay unit-side bypass pipe 342 is increased. In contrast, when the load in the indoor unit 200*b* that performs cooling is increased, the amount of the two-phase gas-liquid refrigerant flowing through the first relay unit-side bypass pipe 342 is reduced. Accordingly, the amount of the refrigerant necessary for the indoor unit 200*a* that performs heating remains unchanged, but the load in the indoor unit-side heat exchanger 210*b* (evaporator) in the indoor unit 200*b* that performs cooling is changed.

Figure 6:
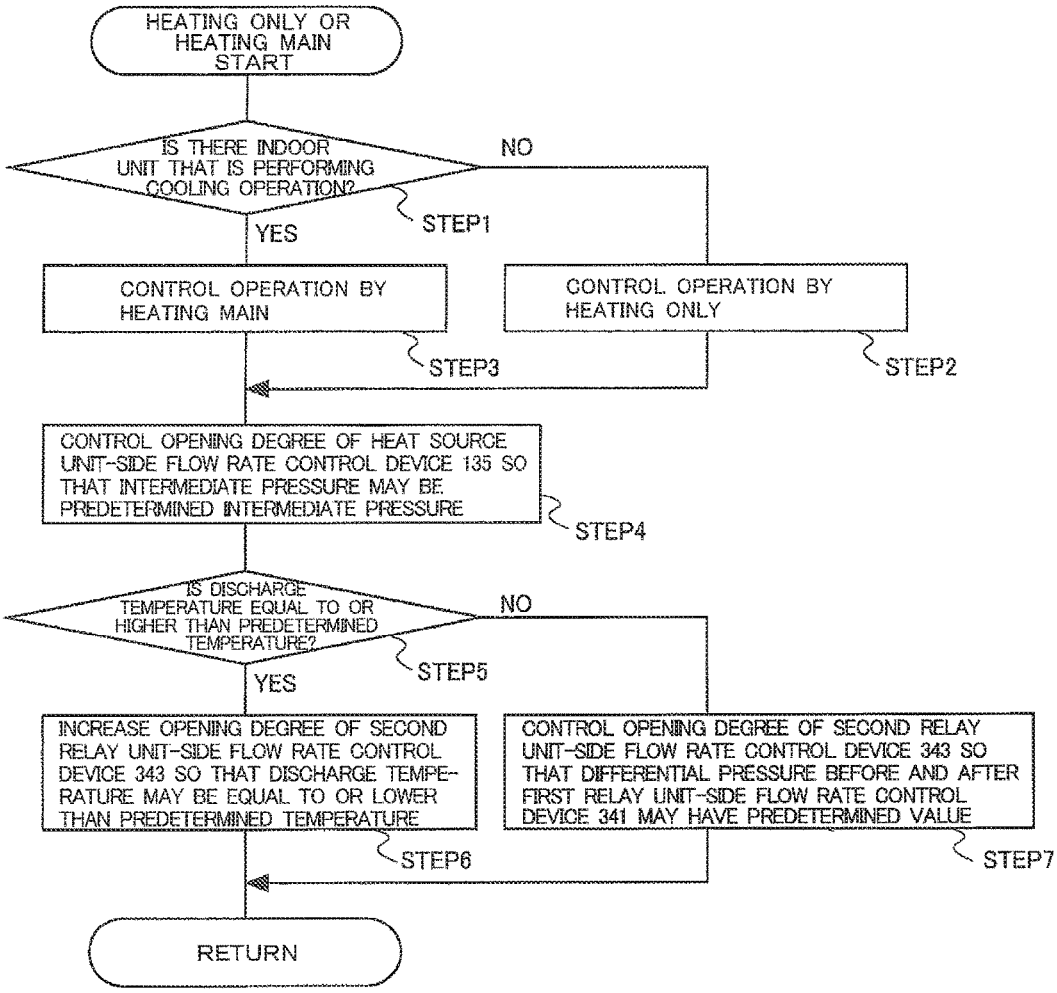
FIG. 6 is a control flowchart for the heating only operation or the heating main operation according to Embodiment 1 of the present invention.

FIG. 6 is a flowchart for performing control in the heating only operation or the heating main operation of the present invention.

The controller 400 determines the presence or absence of an indoor unit 200 that is performing cooling based on a signal transmitted from each indoor unit 200 (STEP1).

When it is determined that no indoor unit 200 is performing cooling, the controller 400 determines that the current operation is the heating only operation, and performs the heating only operation by circulating the refrigerant as described above (STEP2). Meanwhile, when it is determined that there is any one indoor unit 200 that is performing cooling, the controller 400 determines that the current operation is the heating main operation, and performs the heating main operation by circulating the refrigerant as described above (STEP3).

Next, the controller 400 controls the opening degree of the heat source unit-side flow rate control device 135 so that the pressure of the refrigerant in the passage from the indoor unit-side flow rate control device 220 to the heat source unit-side flow rate control device 135 through the second relay unit-side bypass pipe 346, the first relay unit-side bypass pipe 342, and the first main pipe 10 (hereinafter referred to as "intermediate pressure") may be a predetermined pressure determined in advance (hereinafter referred to as "predetermined intermediate pressure") (STEP4).

The opening degree of the heat source unit-side flow rate control device 135 is controlled as follows. Specifically, the controller 400 calculates an opening degree target difference ΔLEV135 of the heat source unit-side flow rate control device 135 so that a saturation temperature TM corresponding to the intermediate pressure, which is detected by the relay unit-side temperature detector 352, may be a saturation temperature (control target value) TMm determined in advance corresponding to the above-mentioned predetermined intermediate pressure based on Expression (1) at fixed time intervals, for example. In Expression (1), k represents a constant set in advance through a test or the like.

$$\Delta LEV135 = k \times (TM - TMm) \quad (1)$$

Then, based on the calculated ΔLEV135, the controller 400 calculates a target opening degree LEV135*m* of the heat source unit-side flow rate control device 135 based on Expression (2). In Expression (2), LEV135 represents a current opening degree.

$$LEV135m = LEV135 + \Delta LEV135 \quad (2)$$

The controller 400 repeats the above-mentioned processing to control the opening degree of the heat source unit-side flow rate control device 135, to thereby control the intermediate pressure.

In the case of the heating main operation, the saturation temperature corresponding to the predetermined intermediate pressure corresponds to the temperature of the refrigerant in the indoor unit 200 (on the low pressure side of the relay unit 300). For example, the temperature of the liquid refrigerant tends to decrease when the outside air temperature decreases. Accordingly, if the temperature of the refrigerant flowing in the indoor unit 200 performing cooling falls below 0 degrees C., the pipe is frozen. To deal with this, the control target value TMm of the saturation temperature corresponding to the predetermined intermediate pressure is set so that the temperature of the refrigerant flowing in the indoor unit 200 performing cooling may be equal to or higher than 0 degrees C. (for example, TMm=2 degrees C.), which can prevent an air passage from being closed due to the freezing of the surface of the heat exchanger of the indoor unit 200.

In the case of the heating only operation, there is no cooling indoor unit 200, and hence it is not particularly necessary to control the intermediate pressure in terms of the refrigeration cycle. However, if the intermediate pressure corresponding to an evaporating temperature of the cooling indoor unit 200 is controlled in advance, the operation mode can be changed promptly when the operation mode transitions from the heating only operation to the heating main operation, and the transient freezing of the heat exchanger of the indoor unit 200 can be avoided.

Figure 7:
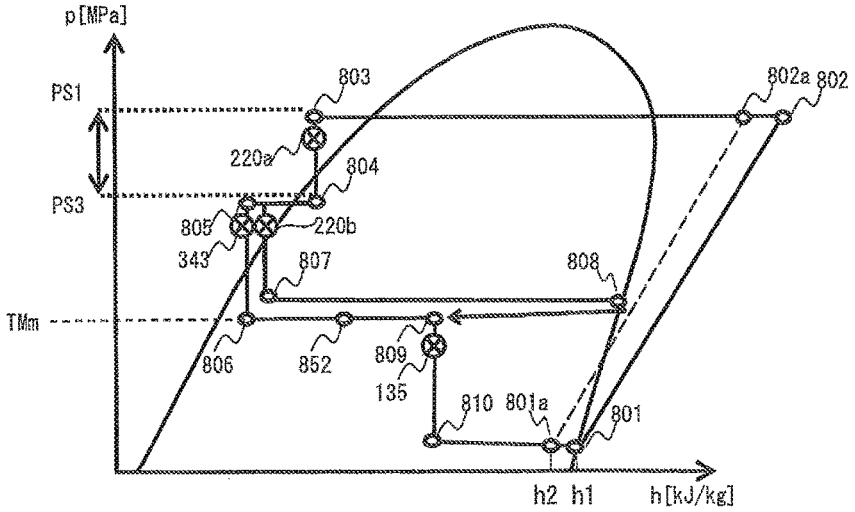
FIG. 7 is a p-h chart in the heating main operation according to Embodiment 1 of the present invention.

FIG. 7 is a p-h chart in the state in which the intermediate pressure is controlled in the heating main operation of the air-conditioning apparatus according to Embodiment 1 of the present invention. Each number in FIG. 7 corresponds to each number in the parentheses in FIG. 5, and represents a refrigerant state at the position of each pipe indicated by the parentheses in FIG. 5. Now, FIG. 7 is described by taking an example in which the indoor unit 200*a* performs a heating operation and the indoor unit 200*b* performs a cooling operation.

A low-temperature and low-pressure gas refrigerant (801) sucked into the compressor 110 is compressed to be a high-temperature and high-pressure gas refrigerant (802). This gas refrigerant passes through the relay unit-side gas-liquid separation device 310 and the first relay unit-side solenoid valve 321*a* to flow into the heating indoor unit 200*a*, and is condensed through heat transfer in the indoor unit-side heat exchanger 210*a* so as to be a low-temperature and high-pressure liquid refrigerant (803). The low-temperature and high-pressure liquid refrigerant (803) is depressurized by the indoor unit-side flow rate control device 220*a* (804), and is cooled by the second relay unit-side heat exchanger 345 (805).

A part of the cooled refrigerant flows to the cooling indoor unit 200*b*, and is depressurized by the indoor unit-side flow rate control device 220*b* to have the intermediate pressure (807). Then, the refrigerant is evaporated by the indoor unit-side heat exchanger 210*b* to be a gas refrigerant having the intermediate pressure (808). Meanwhile, the remaining of the cooled refrigerant is depressurized by the second relay unit-side flow rate control device 343 (806), and after that, the refrigerant is heated through heat exchange in the second relay unit-side heat exchanger 345 and is further heated through heat exchange with a high-pressure side liquid refrigerant circulating through the first relay unit-side heat exchanger 344 (852). Then, the refrigerant heated by the first relay unit-side heat exchanger 344 joins the refrigerant flowing from the cooling indoor unit 200*b* (809), and flows through the first main pipe 10 to flow into the heat source unit 100. The refrigerant flowing into the heat source unit 100 is depressurized by the heat source unit-side flow rate control device 135 (810), and is evaporated through heat reception from the outside air in the heat source unit-side heat exchanger 131, followed by being sucked into the compressor 110 through the four-way switching valve 120 (801).

(Suppression of Excessive Rise in Discharge Temperature Td Under Low Outside Air)

As described above, the second relay unit-side flow rate control device 343 controls the differential pressure between a pressure PS1 detected by the first relay unit-side pressure detector 350 and a pressure PS3 detected by the second relay unit-side pressure detector 351 so that the differential pressure may be equal to or higher than a predetermined differential pressure. Further, as described above, the heat source unit-side flow rate control device 135 controls the saturation temperature TM of the refrigerant detected by the relay unit-side temperature detector 352 so that the saturation temperature TM may have the control target value TMm.

However, in the case where the outside air is lower, the compressor discharge temperature Td rises because the suction pressure of the compressor 110 decreases. Thus, the controller 400 needs to control the discharge temperature Td so that the discharge temperature Td may be equal to or lower than a heat-resistant temperature (for example, 120 degrees C.) of a compressor motor.

To deal with this, for example, the controller 400 performs control of STEP5 and subsequent steps of FIG. 6 as specific control. Specifically, the controller 400 determines whether or not the discharge temperature Td detected by the first heat source unit-side temperature detector 173 is equal to or higher than a predetermined temperature that is lower than the heat-resistant temperature (for example, a temperature that is lower than the heat-resistant temperature by, for example, about 5 degrees C.) (STEP5).

When it is determined that the discharge temperature Td is equal to or higher than the predetermined temperature, the controller 400 increases the opening degree of the second relay unit-side flow rate control device 343 (STEP6). With this, the flow rate of the liquid refrigerant or the two-phase refrigerant passing through the second relay unit-side heat exchanger 345 is increased to decrease the discharge temperature of the compressor 110. Meanwhile, when it is determined in STEP5 that the discharge temperature Td is lower than the predetermined temperature, the controller 400 controls the second relay unit-side flow rate control device 343 so that the differential pressure (=PS1−PS3) before and after the first relay unit-side flow rate control device 341 may have a predetermined value (STEP7). Accordingly, when the discharge temperature of the compressor 110 is decreased to be lower than the predetermined temperature along with the increase in opening degree of the second relay unit-side flow rate control device 343, the controller 400 fixes the opening degree of the second relay unit-side flow rate control device 343 to the opening degree at this time point, and switches to the normal control of the second relay unit-side flow rate control device 343.

As described above, the controller 400 increases the opening degree of the second relay unit-side flow rate control device 343, to thereby control the discharge temperature of the compressor 110 so that the discharge temperature of the compressor 110 may be decreased to be equal to or lower than the heat-resistant temperature.

Now, the reason why the discharge temperature of the compressor 110 can be decreased by increasing the opening degree of the second relay unit-side flow rate control device 343 is described. When the opening degree of the second relay unit-side flow rate control device 343 is increased, the amount of the liquid refrigerant (or the amount of the two-phase gas-liquid refrigerant) flowing into the first relay unit-side bypass pipe 342 is increased, and hence the flow rate of the liquid refrigerant passing through the second relay unit-side heat exchanger 345 is increased. When the flow rate of the liquid refrigerant passing through the second relay unit-side heat exchanger 345 is increased, the enthalpy at the outlet of the heat source unit-side heat exchanger 131 is reduced (801*a*). Accordingly, the enthalpy of the refrigerant flowing out from the heat source unit-side heat exchanger 131 to be sucked into the compressor 110 through the four-way switching valve 120 is also reduced (801).

Specifically, as shown in FIG. 7, the enthalpy of the refrigerant sucked into the compressor 110 before the opening degree of the second relay unit-side flow rate control device 343 is changed is h1, whereas the enthalpy at the same position is reduced to h2 when the opening degree of the second relay unit-side flow rate control device 343 is increased. Because the enthalpy of the refrigerant sucked into the compressor 110 is reduced in this manner, the compression stroke shows a refrigerant change on the broken line in FIG. 7, and hence the discharge temperature can be decreased (802*a*). Consequently, the control of the opening degree of the second relay unit-side flow rate control device 343 can suppress the discharge temperature to be equal to or lower than a predetermined temperature that is lower than the heat-resistant temperature.

As described above, in Embodiment 1, the air-conditioning apparatus capable of the simultaneous cooling and heating operation performs the following control when the discharge temperature is likely to rise beyond the heat-resistant temperature that allows for the operation of the compressor 110 particularly in the heating only operation or the heating main operation under the low outside air environment.

Specifically, the controller 400 increases the opening degree of the second relay unit-side flow rate control device 343 to increase the flow rate of the refrigerant passing through the first relay unit-side bypass pipe 342, to thereby increase the flow rate of the two-phase or liquid refrigerant caused to flow into the pipe between the heat source unit-side heat exchanger 131 and the indoor unit-side heat exchanger 210. With this, the operation in which the discharge temperature is maintained to be equal to or lower than the heat-resistant temperature can be performed. Thus, when the discharge temperature excessively rises, the air can be continuously conditioned without reducing the operating capacity of the compressor or stopping the compressor. Consequently, a highly-reliable air-conditioning apparatus capable of providing the comfort to the user or maintaining the constant temperature in the air-conditioned space can be obtained.

Note that, it is described in Embodiment 1 that the discharge temperature in the heating only operation or the heating main operation under the low outside air environment can be decreased, but the control in Embodiment 1 can also be used to decrease the discharge temperature in the cooling only operation and the cooling main operation under the high outside air environment.

Embodiment 2

Embodiment 2 relates to a reduction in discharge temperature in the cooling only operation or the cooling main operation under high outside air.

Now, Embodiment 2 of the present invention is described in detail with reference to the drawings.

Figure 8:
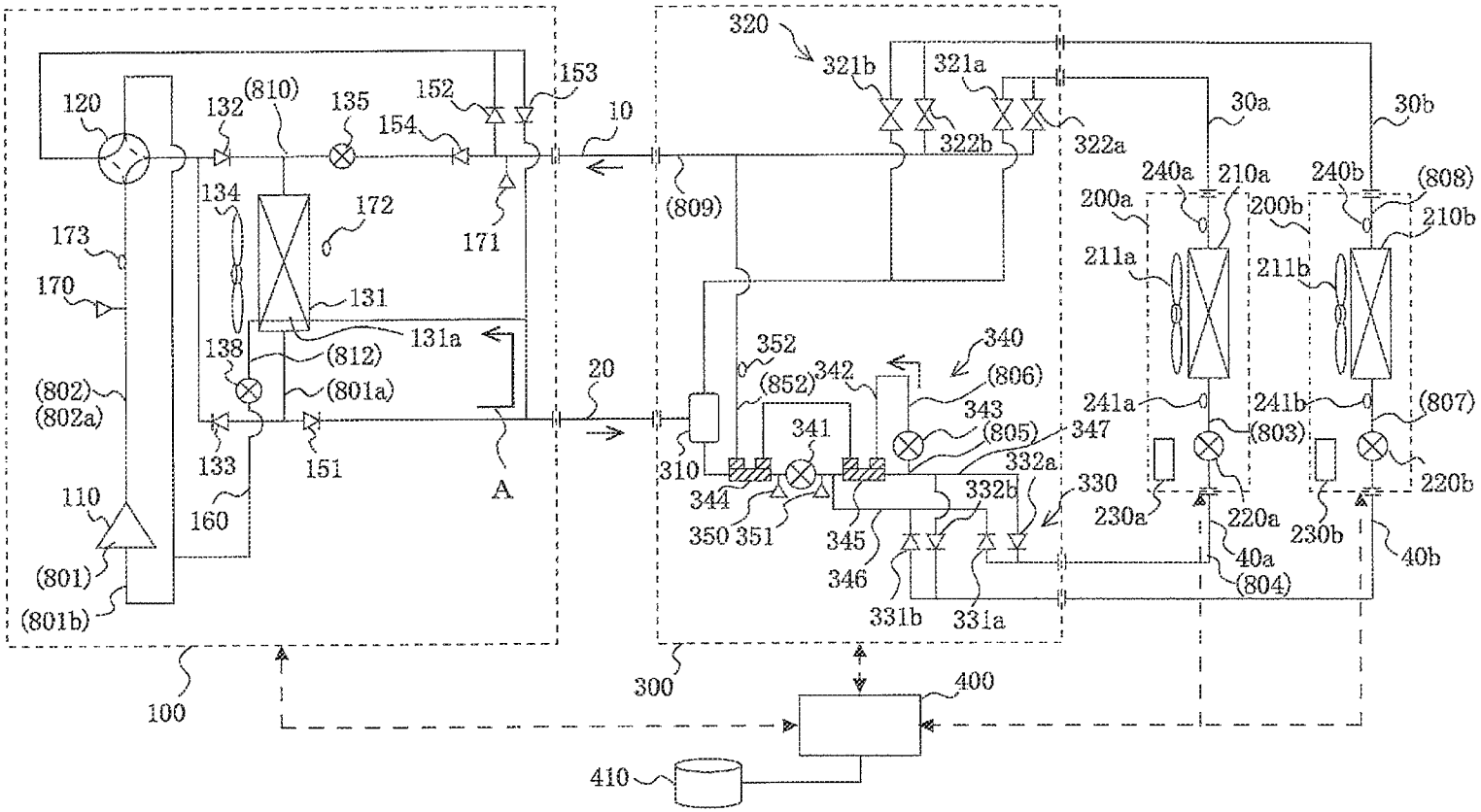
FIG. 8 is a diagram illustrating a configuration of an air-conditioning apparatus and a refrigerant circuit according to Embodiment 2 of the present invention.

FIG. 8 is a diagram illustrating an overall configuration of an air-conditioning apparatus according to Embodiment 2 of the present invention. A refrigerant circuit of FIG. 8 is modified from the refrigerant circuit of Embodiment 1 illustrated in FIG. 1 in that a heat source unit-side bypass pipe 160 is provided, which branches from the pipe extending from the fifth heat source unit-side check valve 153 to reach the second main pipe 20 and is connected to the suction side of the compressor 110. Then, a heat source unit-side bypass flow rate control device 138 for controlling the flow rate of the refrigerant is provided to the heat source unit-side bypass pipe 160.

Further, a part of the heat source unit-side bypass pipe 160 passes through a lower part of the heat source unit-side heat exchanger 131 such that the part of the heat source unit-side bypass pipe 160 functions as a superheated gas cooling heat exchanger 131*a*. In the cooling only operation or the cooling main operation, a part of the refrigerant discharged from the compressor 110 and passing through the heat source unit-side heat exchanger 131 flows in the direction of the arrow A in FIG. 8 to flow into the heat source unit-side bypass pipe

160. The heat source unit-side bypass pipe 160 cools this high-pressure gas refrigerant through heat exchange with the air sent from the heat source unit-side fan 134. Note that, the heat source unit-side bypass pipe 160 is not limited to the configuration in which a part thereof passes below the heat source unit-side heat exchanger 131, and in other words, the heat source unit-side bypass pipe 160 only needs to be configured to cool the high-pressure gas refrigerant flowing into the heat source unit-side bypass pipe 160 and cause the cooled refrigerant to flow into the suction side of the compressor 110. The configuration of cooling a part of the refrigerant that has passed through the heat source unit-side heat exchanger 131, and the heat source unit-side bypass pipe 160 and the heat source unit-side bypass flow rate control device 138 construct a bypass of the present invention.

Figure 9:
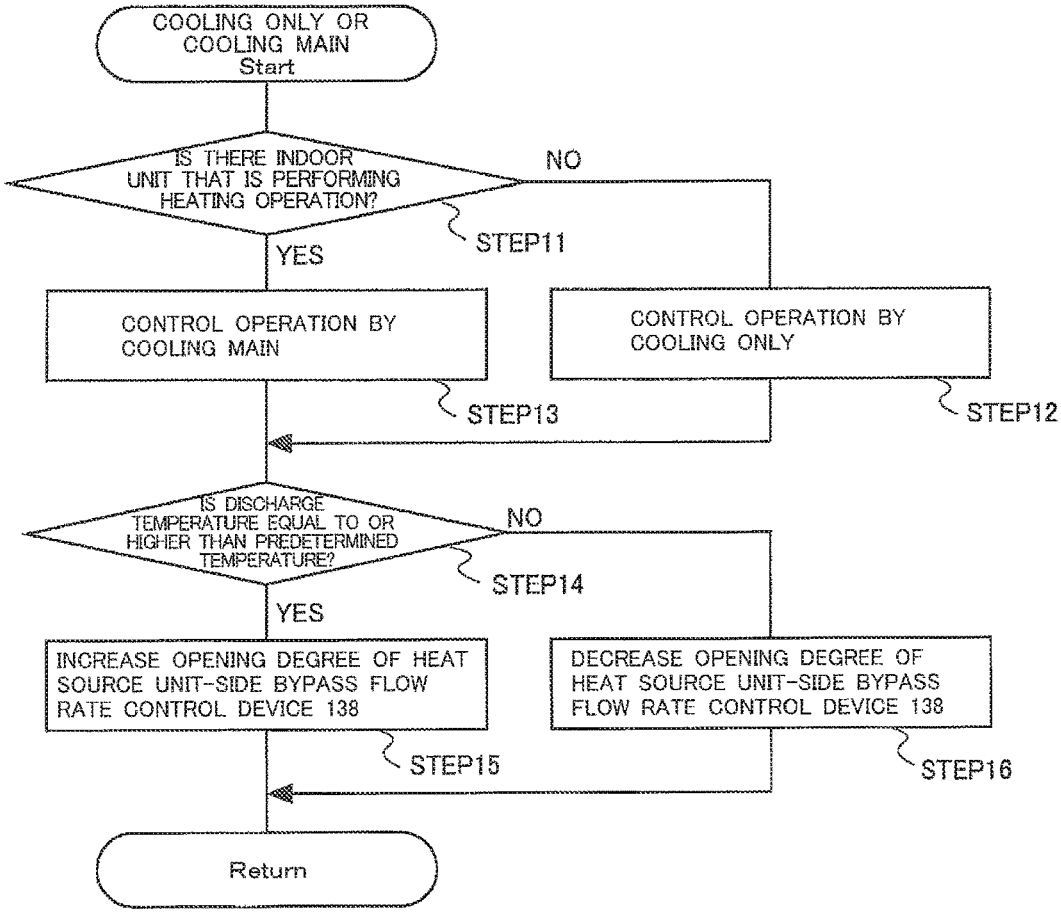
FIG. 9 is a control flowchart for a cooling only operation or a cooling main operation according to Embodiment 2 of the present invention.

FIG. 9 is a flowchart for performing control in the cooling only operation or the cooling main operation of the air-conditioning apparatus according to Embodiment 2 of the present invention.

The controller 400 determines the presence or absence of an indoor unit 200 that is performing heating based on a signal transmitted from each indoor unit 200 (STEP11). When it is determined that no indoor unit 200 is performing heating, the controller 400 determines that the current operation is the cooling only operation, and performs the cooling only operation by circulating the refrigerant as described above (STEP12). Meanwhile, when it is determined that there is any one indoor unit 200 that is performing heating, the controller 400 determines that the current operation is the cooling main operation, and performs the cooling main operation by circulating the refrigerant as described above (STEP13).

Next, the controller 400 determines whether or not the discharge temperature Td detected by the first heat source unit-side temperature detector 173 is equal to or higher than a predetermined temperature (STEP14). When it is determined that the discharge temperature Td is equal to or higher than the predetermined temperature, the controller 400 increases the opening degree of the heat source unit-side bypass flow rate control device 138 (STEP15), to thereby increase the flow rate of the high-pressure gas refrigerant flowing into the heat source unit-side bypass pipe 160. Specifically, in the cooling only operation or the cooling main operation, the high-pressure gas refrigerant discharged from the compressor 110 passes through the heat source unit-side heat exchanger 131 and thereafter flows toward the second main pipe 20, and hence, by increasing the opening degree of the heat source unit-side bypass flow rate control device 138, a part of the high-pressure refrigerant flows in the direction of the arrow A in FIG. 8 to flow into the heat source unit-side bypass pipe 160. Then, the high-pressure gas refrigerant flowing into the heat source unit-side bypass pipe 160 is cooled through heat exchange with the air sent from the heat source unit-side fan 134, and the cooled refrigerant flows into the suction side of the compressor 110. With this, the discharge temperature of the compressor 110 is decreased. Note that, the second relay unit-side flow rate control device 343 is closed.

As described above, the controller 400 increases the opening degree of the heat source unit-side bypass flow rate control device 138, to thereby decrease the discharge temperature of the compressor 110 so as to control the discharge temperature of the compressor 110 to be equal to or lower than a predetermined temperature that is lower than the heat-resistant temperature. Note that, when it is determined in STEP14 that the discharge temperature Td is lower than the predetermined temperature, the controller 400 decreases the opening degree of the heat source unit-side bypass flow rate control device 138 (STEP16) to decrease the bypass flow rate.

Figure 10:
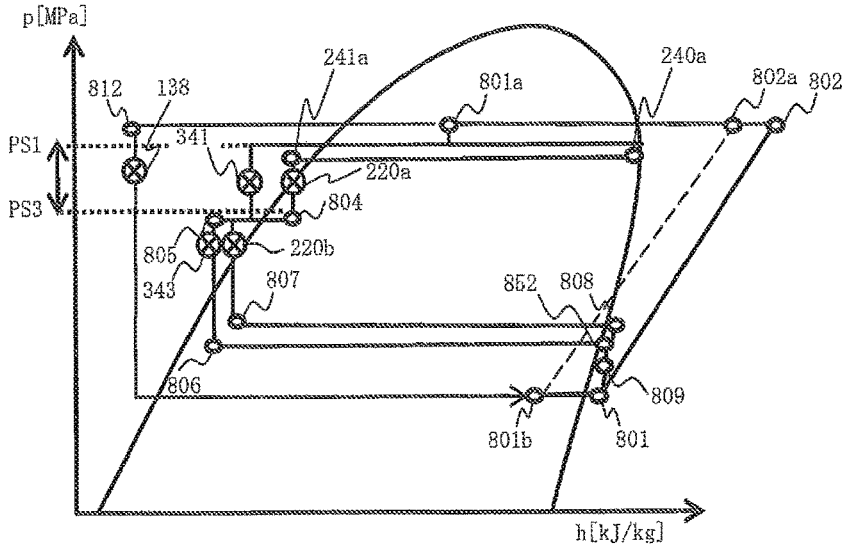
FIG. 10 is a p-h chart in the cooling main operation according to Embodiment 2 of the present invention.

FIG. 10 is a p-h chart in the cooling main operation of the air-conditioning apparatus according to Embodiment 2 of the present invention. Each number in FIG. 10 corresponds to each number in the parentheses in FIG. 8, and represents a refrigerant state at the position of each pipe indicated by the parentheses in FIG. 8. Note that, in FIG. 8, only the portions necessary for the following description are indicated by the parentheses. Now, FIG. 10 is described.

When the temperature of the high-temperature and high-pressure gas refrigerant (802) discharged from the compressor 110 is equal to or higher than a predetermined temperature that is lower than the heat-resistant temperature, the controller 400 increases the opening degree of the heat source unit-side bypass flow rate control device 138 as described above. Then, a part of a high-temperature and high-pressure two-phase refrigerant flowing through the third heat source unit-side check valve 151 transfers heat by the superheated gas cooling heat exchanger 131*a* to be cooled to around the outside air temperature (812). The cooled refrigerant is depressurized by the heat source unit-side bypass flow rate control device 138, and joins a low-pressure refrigerant passing through the four-way switching valve 120. With this, the enthalpy of the refrigerant sucked into the compressor 110 is reduced (801*b*). Because the enthalpy of the refrigerant sucked into the compressor 110 is reduced, the compression stroke shows a refrigerant change on the broken line in FIG. 10, and hence the discharge temperature can be decreased (802*a*). Consequently, the control of the opening degree of the heat source unit-side bypass flow rate control device 138 can suppress the discharge temperature to be equal to or lower than the predetermined temperature that is lower than the heat-resistant temperature.

As described above, in Embodiment 2, the air-conditioning apparatus capable of the simultaneous cooling and heating operation performs the following control when the discharge temperature is likely to rise beyond the heat-resistant temperature that allows for the operation of the compressor 110 particularly in the cooling only operation or the cooling main operation under the high outside air. Specifically, the controller 400 increases the opening degree of the heat source unit-side bypass flow rate control device 138 so that the refrigerant having a low enthalpy cooled by the heat source unit-side fan 134 may be supplied to the suction side of the compressor 110. With this, the operation in which the discharge temperature is maintained to be equal to or lower than the heat-resistant temperature can be performed. Thus, when the discharge temperature excessively rises, the air can be continuously conditioned without reducing the operating capacity of the compressor or stopping the compressor. Consequently, a highly-reliable air-conditioning apparatus capable of providing the comfort to the user or maintaining the constant temperature in the air-conditioned space can be obtained.

Further, in the case of decreasing the discharge temperature, Embodiment 1 employs the circuit configuration in which the refrigerant after passing through the heating indoor unit is bypassed, and hence the cooling capacity is slightly decreased. However, Embodiment 2 employs the circuit configuration in which the refrigerant before passing through the heating indoor unit is bypassed, and hence the compressor operating capacity can be enhanced and the high-pressure refrigerant can be bypassed to decrease the discharge temperature. Consequently, the operation in which the heating capacity and the cooling capacity are not insufficient with respect to the air conditioning load can be performed to enhance the comfort in the indoor space.

Note that, in Embodiment 2, a part of the high-pressure gas refrigerant, which has been discharged from the compressor 110 and passed through the heat source unit-side heat exchanger 131, is cooled and supplied to the suction side of the compressor 110. Alternatively, however, a part of the high-pressure gas refrigerant may be supplied to an intermediate portion of the compression stroke of the compressor 110. Also in this case, the same effects can be obtained.

Further, a description has been predetermined of the discharge temperature decreasing function of the heat source unit-side bypass pipe 160 and the heat source unit-side bypass flow rate control device 138 in the cooling only operation and the cooling main operation. However, the heat source unit-side bypass pipe 160 and the heat source unit-side bypass flow rate control device 138 exert the discharge temperature decreasing function in the heating only operation and the heating main operation as well. Specifically, in the heating only operation and the heating main operation, a part of the high-pressure gas refrigerant discharged from the compressor 110 flows into the heat source unit-side bypass pipe 160.

Then, the high-pressure gas refrigerant flowing into the heat source unit-side bypass pipe 160 is cooled through heat exchange with air sent from the heat source unit-side fan 134, and is thereafter depressurized by the heat source unit-side bypass flow rate control device 138, followed by joining the suction side of the compressor 110. Consequently, the discharge temperature of the compressor 110 can be decreased.

Figure 11:
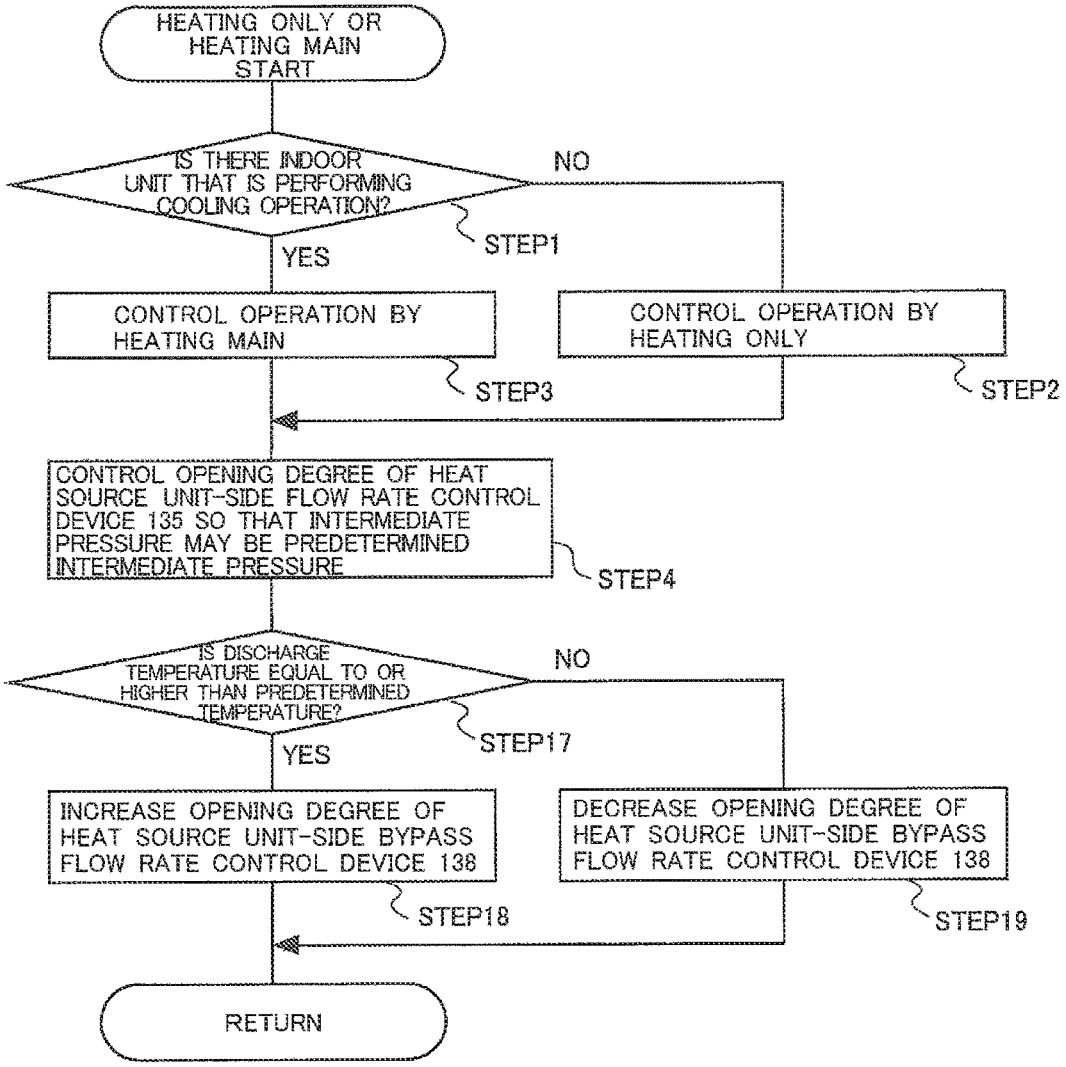
FIG. 11 is a control flowchart for a heating only operation or a heating main operation according to Embodiment 2 of the present invention.

As specific control, as illustrated in FIG. 11 (STEP1 to STEP4 are the same as in FIG. 6 of Embodiment 1), it is determined whether or not the discharge temperature Td is equal to or higher than a predetermined temperature (STEP17). Then, when it is determined that the discharge temperature Td is equal to or higher than the predetermined temperature, the controller 400 increases the opening degree of the heat source unit-side bypass flow rate control device 138 (STEP18), and, when it is determined that the discharge temperature Td is less than the predetermined temperature, the controller 400 reduces the opening degree of the heat source unit-side bypass flow rate control device 138 (STEP19).

Embodiment 3

Now, Embodiment 3 of the present invention is described in detail with reference to the drawings.

Figure 12:
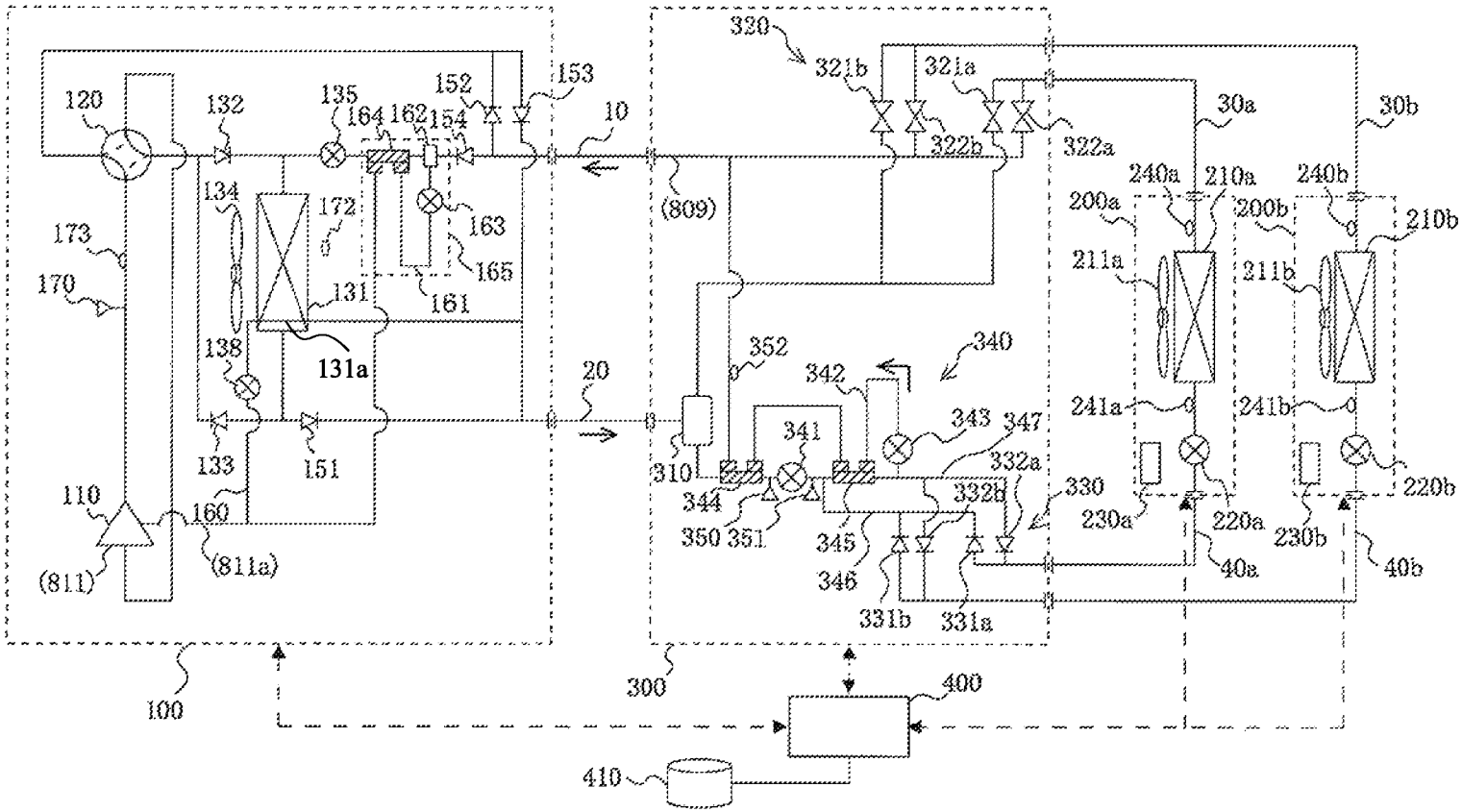
FIG. 12 is a diagram illustrating a configuration of an air-conditioning apparatus and a refrigerant circuit according to Embodiment 3 of the present invention.

FIG. 12 is a diagram illustrating an overall configuration of an air-conditioning apparatus according to Embodiment 3 of the present invention. The refrigerant circuit includes an injection section 165 in addition to the refrigerant circuit of Embodiment 2. The injection section 165 includes an injection pipe 161, a heat source unit-side gas-liquid separation device 162, an injection flow rate control device 163, and an injection heat exchanger 164.

The injection pipe 161 is connected to an injection port (not shown) formed in a middle portion in the compression stroke of the compressor 110, and causes refrigerant to flow therethrough, which is caused to flow to the compression process of the compressor 110 through the injection port. The heat source unit-side gas-liquid separation device 162 separates the refrigerant flowing from the relay unit 300 into a gas refrigerant and a liquid refrigerant so that a part of the liquid refrigerant may basically flow to the injection flow rate control device 163 side. Based on an instruction from the controller 400, the injection flow rate control device 163 adjusts the flow rate of the refrigerant passing through the injection pipe 161 and the pressure of the refrigerant. The injection heat exchanger 164 exchanges heat between the refrigerant flowing on the injection pipe 161 side and the refrigerant flowing on the heat source unit-side heat exchanger 131 side.

With the injection section 165 configured as described above, for example, when the amount of the refrigerant to be sucked by the compressor 110 is decreased in the low outside air environment, the refrigerant is caused to flow into the compressor 110 through the injection port, to thereby compensate for the decrease in amount of the sucked refrigerant. Consequently, the discharge capacity can be enhanced, and the capacity for supplying the refrigerant to the indoor unit 200 that is performing heating can be prevented from being reduced. This point is described later again.

Now, the position of the heat source unit-side gas-liquid separation device 162 is described. The injection section 165 is a component provided in order to cause refrigerant to flow into the compressor 110 through the injection pipe 161 basically in heating operation (in heating only operation or heating main operation), and hence it is desired to provide the injection section 165 at the position not affecting the flow of the refrigerant in cooling operation (in cooling only operation or cooling main operation). Accordingly, in Embodiment 3, the heat source unit-side gas-liquid separation device 162 is provided between the heat source unit-side heat exchanger 131 and the sixth heat source unit-side check valve 154. In cooling, the refrigerant at this position is a high-pressure gas refrigerant, and the opening degree of the injection flow rate control device 163 is controlled to be zero so as not to perform the injection. A low-pressure gas refrigerant, which is most susceptible to the pressure loss, does not flow through the heat source unit-side gas-liquid separation device 162. Consequently, the cooling capacity can be exhibited without being affected by the pressure loss.

Figure 13:
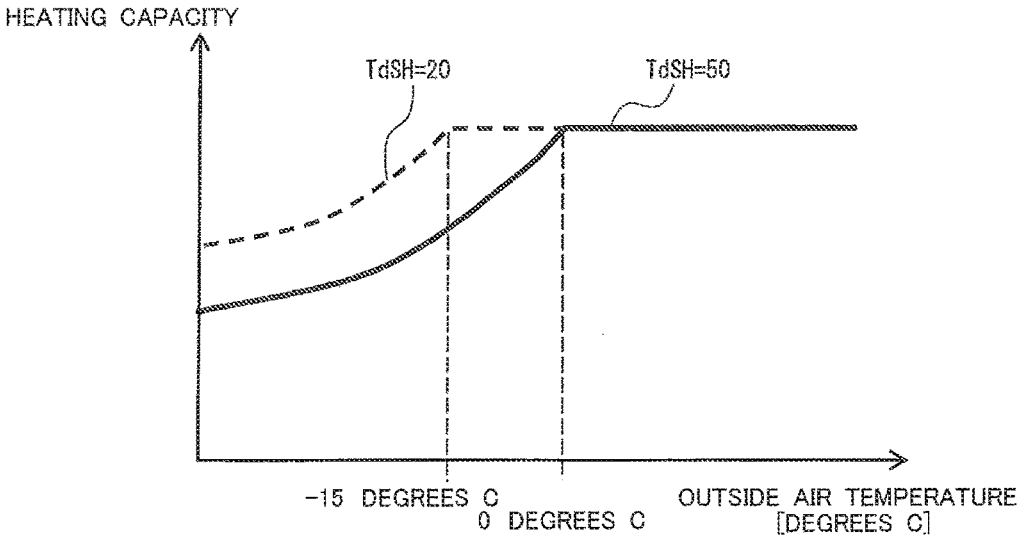
FIG. 13 is a graph showing a relationship between an outside air temperature and a heating capacity according to Embodiment 3 of the present invention.

FIG. 13 is a graph showing the relationship among the outside air temperature, the heating capacity, and a discharge superheat degree TdSH. When the outside air temperature is decreased, the pressure in the heat source unit-side heat exchanger 131 serving as an evaporator (the pressure on the suction side of the compressor 110) is reduced. Accordingly, the amount of refrigerant to be sucked into the compressor 110 (circulating refrigerant) is reduced (refrigerant density is reduced), and the temperature of the refrigerant to be discharged from the compressor 110 is increased.

For example, in FIG. 13, in the case where the refrigerant is not supplied to the compressor 110 through the injection and the discharge superheat degree TdSH is 50 degrees C., the heating capacity is reduced when the outside air temperature becomes lower than 0 degrees C. as indicated by the thick line, and hence it is difficult to maintain the heating capacity of 100%. This is because the pressure of the refrigerant in the whole pipes in the refrigerant circuit is reduced when the outside air temperature becomes lower than 0 degrees C. This tendency is specific to an electronic heat pump air-conditioning apparatus. To deal with this, the injection is performed to compensate for the refrigerant, to thereby reduce the discharge superheat degree TdSH and maintain the pressure so as to secure the necessary heating capacity for all the indoor units 200 that perform heating.

For example, in the heating only operation using the injection for compensating for the insufficient flow rate of the refrigerant, the controller 400 controls the opening degree of the injection flow rate control device 163 so that, for example, the target discharge superheat degree TdSH may be 20 degrees C. This control can maintain the heating capacity to 100% until the outside air becomes lower than about −15 degrees C. as shown in FIG. 13.

Further, the pressure loss tends to increase as the driving frequency of the compressor 110 becomes higher, and hence, also in terms of energy efficiency, it is effective to use the refrigerant supply by the injection so as to supply the necessary capacity while reducing the driving frequency of the compressor 110 to increase the compression ratio.

When the flow rate of the refrigerant flowing through the injection pipe 161 is increased, the efficiency relating to the operation is reduced. However, when the heating capacity is necessary (when the operating capacity of the compressor is large), the capacity is preferentially supplied at the expense of efficiency. For this reason, when the heating capacity is necessary, the target discharge superheat degree is reduced to increase the flow rate of the refrigerant flowing through the injection pipe 161. Meanwhile, when the operating capacity of the compressor is small, the target discharge superheat degree only needs to be increased to reduce the flow rate of the refrigerant flowing through the injection pipe 161 in order to prioritize efficiency.

The controller 400 determines the target discharge superheat degree in accordance with the operating capacity of the compressor 110 based on data stored in the storage device 410. Then, the controller 400 controls the opening degree of the injection flow rate control device 163 so that the determined target discharge superheat degree may be reached.

Figure 14:
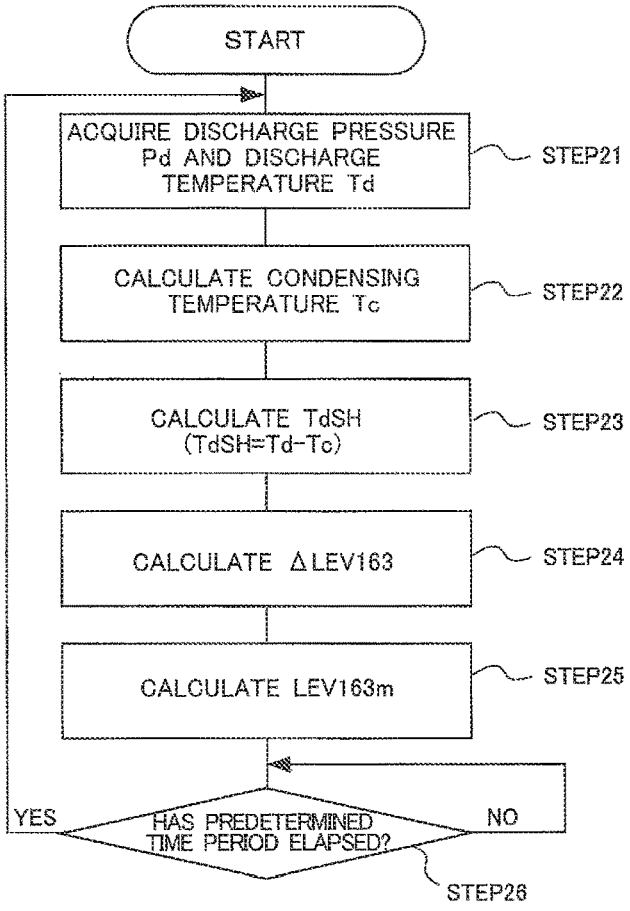
FIG. 14 is a flowchart relating to processing of controlling an opening degree of an injection flow rate control device according to Embodiment 3 of the present invention.

FIG. 14 is a flowchart relating to the processing of controlling the opening degree of the injection flow rate control device of FIG. 12. The controller 400 acquires a discharge pressure Pd by calculation based on the signal from the first heat source unit-side pressure detector 170, and acquires a discharge temperature Td by calculation based on the signal from the first heat source unit-side temperature detector 173 (STEP21). Further, the controller 400 calculates a condensing temperature Tc based on the discharge pressure Pd (STEP22), and calculates a discharge superheat degree TdSH corresponding to the difference between the discharge temperature Td and the condensing temperature Tc (STEP23). In addition, the controller 400 calculates a difference ΔLEV163 from the opening degree target of the injection flow rate control device 163 based on Expression (3) (STEP24). In Expression (3), TdSHm represents a target discharge superheat degree and k2 represents a constant.

$$\Delta LEV163 = k2 \times (TdSH - TdSHm) \quad (3)$$

Then, based on the calculated ΔLEV163, the controller 400 calculates a next target opening degree LEV163*m* of the injection flow rate control device 163 based on Expression (4) (STEP25). In Expression (4), LEV163 represents a current opening degree.

$$LEV163m = LEV163 + \Delta LEV163 \quad (4)$$

The controller 400 repeats the above-mentioned processing at predetermined time periods (STEP26) to control the opening degree of the injection flow rate control device 163, to thereby control the flow rate of the refrigerant flowing through the injection pipe 161.

Note that, in the above description, the injection flow rate control device is controlled so that the discharge superheat degree may be a target discharge superheat degree. Alternatively, however, the injection flow rate control device may be controlled so that the discharge temperature Td may be a target discharge temperature.

Figure 15:
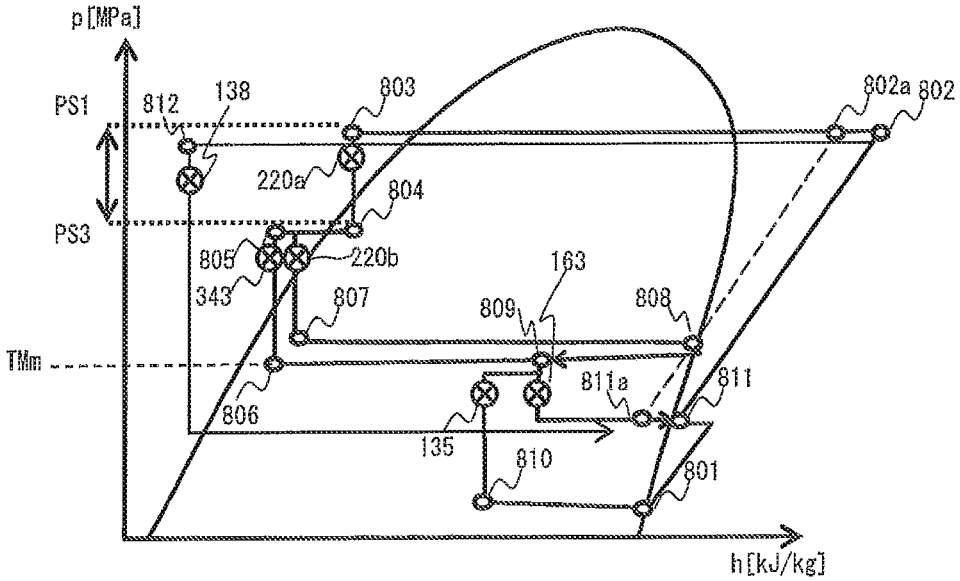
FIG. 15 is a p-h chart in a heating main operation according to Embodiment 3 of the present invention.

FIG. 15 is a p-h chart in the heating main operation of the air-conditioning apparatus according to Embodiment 3 of the present invention. Each number in FIG. 15 corresponds to each number in the parentheses in FIG. 12, and represents a refrigerant state at the position of each pipe indicated by the parentheses in FIG. 12. Note that, in FIG. 12, only the portions necessary for the following description are indicated by the parentheses. Now, parts different from Embodiment 2 are mainly described with reference to FIG. 15.

The refrigerant passing through the sixth heat source unit-side check valve 154 is separated by the heat source unit-side gas-liquid separation device 162 into a gas refrigerant and a liquid refrigerant, and a part of the liquid refrigerant flows into the injection section 165. The liquid refrigerant flowing into the injection section 165 is depressurized by the injection flow rate control device 163, and exchanges heat in the injection heat exchanger 164 with the refrigerant passing on the high-pressure side of the injection heat exchanger 164.

A two-phase gas-liquid refrigerant after the heat exchange in the injection heat exchanger 164 joins the refrigerant flowing out from the heat source unit-side bypass flow rate control device 138 (811*a*), and is injected into the compression stroke of the compressor 110. Inside the compressor 110, the injected refrigerant and the refrigerant compressed to have the intermediate pressure join each other (811). The injection can reduce the refrigerant enthalpy in the compression stroke to suppress the rise in discharge temperature (802*a*).

However, when the cooling load of the indoor unit 200 is high in the heating main operation or when the heating load and the cooling load are substantially equal to each other in the simultaneous cooling and heating operation, the refrigerant state (809) in the first main pipe 10 is close to a saturated gas state with an increased enthalpy. Accordingly, the enthalpy of the refrigerant flowing into the injection flow rate control device 163 is increased to reduce the effect of suppressing the rise in discharge temperature obtained by the injection.

To deal with this, similarly to Embodiment 2, it is determined whether or not the discharge temperature Td is equal to or higher than a predetermined temperature that is lower than the heat-resistant temperature, and, when the discharge temperature Td is equal to or higher than the predetermined temperature, the opening degree of the heat source unit-side bypass flow rate control device 138 is increased to control the discharge temperature of the compressor 110 to be equal to or lower than the predetermined temperature. When the discharge temperature Td is lower than the predetermined temperature, the opening degree of the heat source unit-side bypass flow rate control device 138 only needs to be decreased to reduce the bypass flow rate.

As described above, according to Embodiment 3, the same effects as those in Embodiment 2 can be obtained, and further, the following effect can be obtained because the injection section 165 injects the two-phase refrigerant into the compressor 110. Specifically, the problem of the reduction in rise suppression effect for the discharge temperature obtained by the injection, which occurs when the number of cooling indoor units in operation is high under the low outside air environment and in the heating main operation, can be solved by increasing the opening degree of the heat source unit-side bypass flow rate control device 138.

Note that, Embodiment 3 uses the method of Embodiment 2 (that is, increasing the opening degree of the heat source unit-side bypass flow rate control device 138) as the countermeasure against the reduction in rise suppression effect for the discharge temperature obtained by the injection. Alternatively, however, the method of Embodiment 1 (that is, increasing the opening degree of the second relay unit-side flow rate control device 343) may be used.

Embodiment 4

Now, Embodiment 4 of the present invention is described in detail with reference to the drawings.

Figure 16:
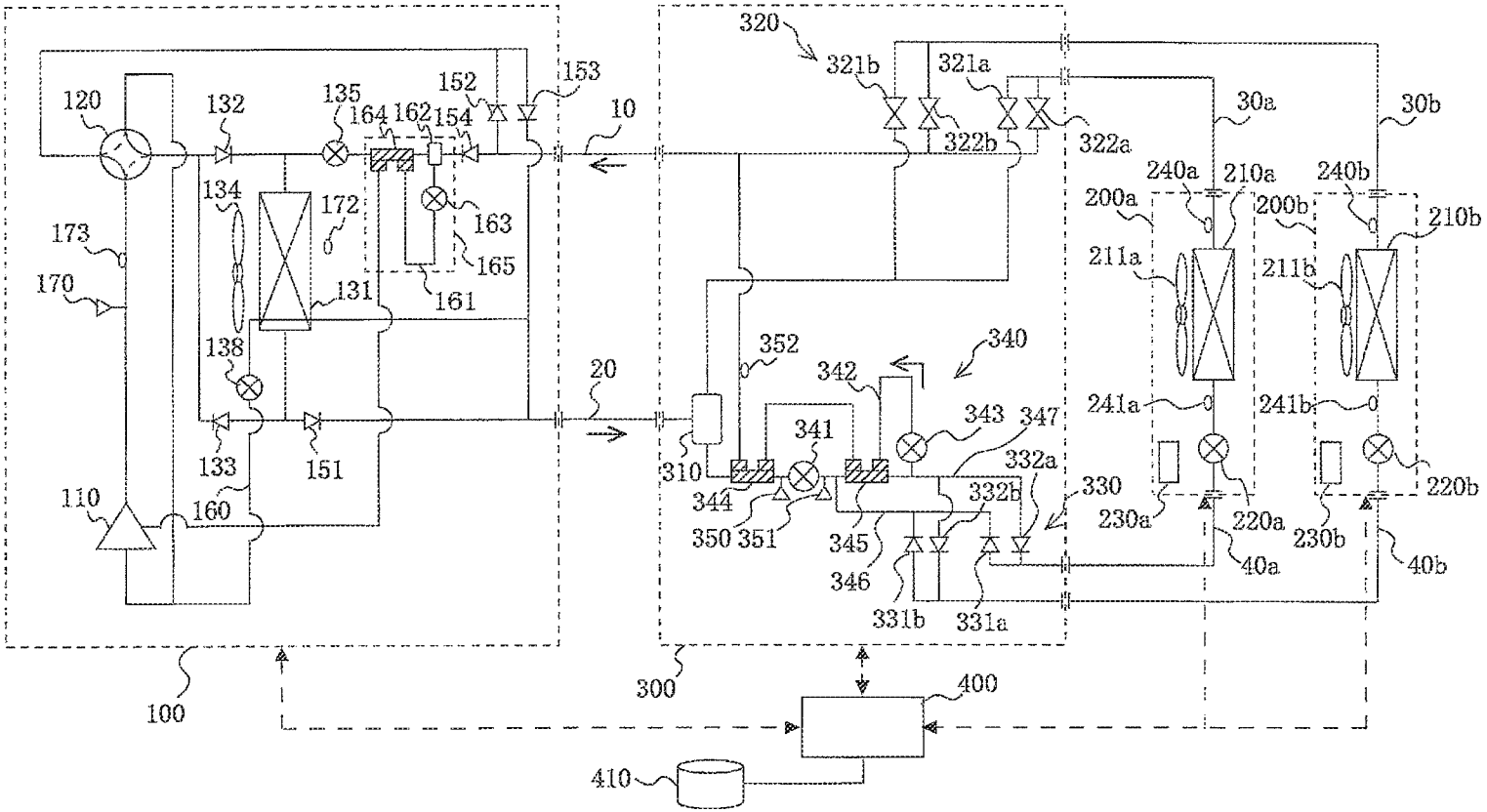
FIG. 16 is a diagram illustrating a configuration of an air-conditioning apparatus and a refrigerant circuit according to Embodiment 4 of the present invention.

FIG. 16 is a diagram illustrating an overall configuration of an air-conditioning apparatus according to Embodiment 4 of the present invention. In Embodiment 3, the refrigerant flowing out from the heat source unit-side bypass flow rate control device 138 joins the refrigerant passing through the injection heat exchanger 164 of the injection section 165, and thereafter flows into the middle of the compression stroke of the compressor 110. In contrast, in Embodiment 4, the refrigerant flowing out from the heat source unit-side bypass flow rate control device 138 flows into the suction side of the compressor 110. The other configurations are the same as those in Embodiment 3.

Figure 17:
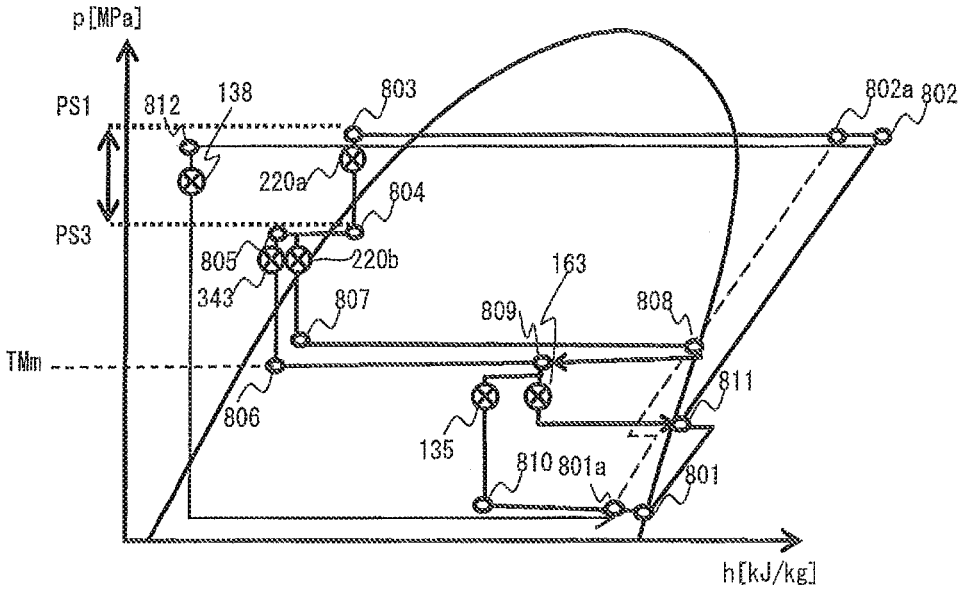
FIG. 17 is a p-h chart in a heating main operation according to Embodiment 4 of the present invention.

FIG. 17 is a p-h chart in a heating main operation of the air-conditioning apparatus according to Embodiment 4 of the present invention. As is apparent from comparison between FIG. 17 and FIG. 15, in FIG. 17, the refrigerant depressurized by the heat source unit-side bypass flow rate control device 138 joins a low-pressure portion rather than an intermediate-pressure portion.

Similarly to Embodiment 2, when the discharge temperature of the compressor 110 rises, the refrigerant with a low enthalpy is caused to flow into the suction side of the compressor 110. Consequently, the same effects as described above are exerted.

Note that, the present invention is not intended to particularly limit the kind of refrigerant. For example, any one of natural refrigerants such as carbon dioxide (CO2), hydrocarbons, and helium, alternative refrigerants free from chlorine such as R410A, R32, R407C, R404A, HFO1234yf, and HFO1234ze, and fluorocarbon refrigerants used in existing products such as R22 may be employed. In particular, R32 is a refrigerant with which the discharge temperature of the compressor is liable to excessively rise because the discharge temperature of the compressor rises by about 30 degrees C. as compared with R410A, R407C, R22, and other such refrigerants in terms of refrigerant physical properties. Thus, the application of the present invention can obtain a highly-reliable air-conditioning apparatus.

The invention claimed is:

1. An air-conditioning apparatus capable of performing a cooling and heating mixed operation, including:

a refrigerant circuit formed by piping connection of:

a heat source unit having a compressor, a single heat source unit-side heat exchanger configured to exchange heat between an outside air and a refrigerant, a heat source unit-side flow rate control device, and a four-way switching valve, a plurality of indoor units each having an indoor unit-side heat exchanger configured to exchange heat between an air to be conditioned and the refrigerant, and an indoor unit-side flow rate control device, and a relay unit connected between the heat source unit and the plurality of indoor units, and configured to form a passage for supplying a gas refrigerant to the indoor unit that performs heating and supplying a liquid refrigerant to the indoor unit that performs cooling, the air-conditioning apparatus comprising:

a bypass passing through a part of the single heat source unit-side heat exchanger, and configured to turn a part of the refrigerant, which is discharged from the compressor; and which passes through the single heat source unit-side heat exchanger, and which is yet to flow into the relay unit, into a two-phase gas-liquid state or a liquid state by exchanging heat with the outside air, the bypass causing the refrigerant to flow into a suction side of the compressor or an intermediate portion of a compression stroke of the compressor;

a bypass flow rate control device provided to the bypass; and a controller configured to control the bypass flow rate control device based on a discharge temperature of a discharge refrigerant discharged from the compressor.

2. The air-conditioning apparatus of claim 1, wherein, when the discharge temperature of the discharge refrigerant becomes equal to or higher than a predetermined temperature that is lower than a heat-resistant temperature, the controller increases an opening degree of the bypass flow rate control device so that the discharge temperature of the discharge refrigerant becomes lower than the predetermined temperature.

3. The air-conditioning apparatus of claim 2, wherein the bypass functions as a superheated gas cooling heat exchanger configured to exchange heat of a part of the refrigerant, which is discharged from the compressor and passes through the heat source unit-side heat exchanger, with the outside air, to be turned into the two-phase gas-liquid state or the liquid state.

4. The air-conditioning apparatus of claim 1, further comprising an injection section configured to supply, in an operation in which the heat source unit-side heat exchanger functions as an evaporator, two-phase gas-liquid refrigerant from the relay unit to the intermediate portion of the compression stroke of the compressor.

5. The air-conditioning apparatus of claim 4, wherein the injection section includes an injection pipe that branches from an upstream of the heat source unit-side flow rate control device in the heat source unit to reach the intermediate portion of the compression stroke of the compressor, and an injection flow rate control device provided to the injection pipe, and wherein the controller determines a target discharge superheat degree based on an operating capacity of the compressor, and controls the injection flow rate control device so that a discharge superheat degree of the compressor becomes the determined target discharge superheat degree.

6. The air-conditioning apparatus of claim 5, wherein the injection section further includes an injection heat exchanger configured to exchange, in the operation in which the heat source unit-side heat exchanger functions as an evaporator, heat between refrigerant, which passes through the relay unit to be directed to the heat source unit-side flow rate control device, and refrigerant, which passes through the injection flow rate control device in the injection pipe.

7. The air-conditioning apparatus of claim 1, wherein the refrigerant includes R32.

8. The air-conditioning apparatus of claim 1, wherein in an operation in which the heat source unit-side heat exchanger functions as a condenser, the bypass flows the refrigerant into one of the suction side of the compressor and the intermediate portion of the compression stroke of the compressor, and the controller controls, in the operation in which the heat source unit-side heat exchanger functions as a condenser, an opening degree of the bypass flow rate control device so that the discharge temperature becomes equal to or lower than a heat-resistant temperature of the compressor.

9. The air-conditioning apparatus of claim 1, wherein the bypass functions as a superheated gas cooling heat exchanger configured to exchange heat of a part of the refrigerant, which is discharged from the compressor and passes through the heat source unit-side heat exchanger, with the outside air, to be turned into the two-phase gas-liquid state or the liquid state, and the bypass flow rate control device is provided between the superheated gas cooling heat exchanger and the suction side of the compressor or the intermediate portion of the compression stroke of the compressor so that the refrigerant flowing out from the superheated gas cooling heat exchanger flows into the bypass flow rate control device.

* * * * *